US008373732B2

(12) United States Patent
Takahashi et al.

(10) Patent No.: US 8,373,732 B2
(45) Date of Patent: Feb. 12, 2013

(54) LIQUID DROPLET FLIGHT DEVICE AND IMAGE FORMING APPARATUS WITH ELECTROWETTING DRIVE ELECTRODE

(75) Inventors: Hiroshi Takahashi, Kanagawa (JP); Ichiro Kadota, Kanagawa (JP); Toshihiro Kanematsu, Kanagawa (JP); Masaaki Yamada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 761 days.

(21) Appl. No.: 12/194,107

(22) Filed: Aug. 19, 2008

(65) Prior Publication Data

US 2009/0051735 A1 Feb. 26, 2009

(30) Foreign Application Priority Data

Aug. 22, 2007 (JP) ..... 2007-215461
Aug. 22, 2007 (JP) ..... 2007-215498

(51) Int. Cl.
*B41J 2/405* (2006.01)

(52) U.S. Cl. ..... 347/147; 347/55

(58) Field of Classification Search ..... 347/20, 347/54, 55, 73–75
See application file for complete search history.

(56) References Cited

U.S. PATENT DOCUMENTS 3,967,286 A * 6/1976 Andersson et al. ..... 347/87
5,293,678 A * 3/1994 Chamberlain et al. ..... 29/401.1
5,734,355 A * 3/1998 Watanabe ..... 343/859
6,328,426 B1 * 12/2001 Chahn et al. ..... 347/55
2005/0116069 A1 * 6/2005 Murata ..... 239/690
2006/0017782 A1 * 1/2006 Nishi et al. ..... 347/55
2006/0043212 A1 * 3/2006 Nishi et al. ..... 239/102.1
2006/0066701 A1 * 3/2006 Hirakawa ..... 347/101
2007/0101934 A1 * 5/2007 Nishio et al. ..... 118/629
2007/0195152 A1 * 8/2007 Kawai et al. ..... 347/112

FOREIGN PATENT DOCUMENTS

JP 11-198381 7/1999
JP 2000-168092 6/2000
JP 2004-165587 6/2004
WO WO 2005021273 A1 * 3/2005

* cited by examiner

*Primary Examiner* — Mark Robinson
*Assistant Examiner* — Andrew Jordan
(74) *Attorney, Agent, or Firm* — Oblon, Spivak, McClelland, Maier & Neustadt, L.L.P.

(57) ABSTRACT

A liquid droplet flight device is provided that moves an ink or the like using a comparatively low voltage and stably causes flight of even a high viscosity ink or the like. When causing droplets of a liquid inside a liquid retaining section to fly onto a medium transported between liquid droplet discharge means and an opposing electrode in the liquid droplet flight device, a high voltage is applied to the flight electrode from a bias power source to generate an electric field between the flight electrode and the opposing electrode. On/off control of flight control means is performed in this state to apply a drive voltage of a low voltage to an EW drive electrode from a drive power source such that the liquid inside a slit moves to a leading end portion of the flight electrode due to an electrowetting phenomenon, and the liquid that has moved to the leading end portion of the flight electrode flies toward the opposing electrode through the electric field such that a liquid droplet lands on the medium.

19 Claims, 25 Drawing Sheets

LIQUID DROPLET FLIGHT DEVICE AND IMAGE FORMING APPARATUS WITH ELECTROWETTING DRIVE ELECTRODE

BACKGROUND OF THE INVENTION

1. Field of the Invention

The present invention relates to liquid droplet flight devices and liquid droplet flight methods that are used in image forming apparatuses such as copiers, printer apparatuses, and facsimile machines to induce flight of liquid droplets such as ink liquid droplets, and particularly relates liquid droplet flight devices and liquid droplet flight methods capable of stably forming high image quality images by causing stable flight of liquid droplets using an electrostatic attraction method.

2. Description of the Related Art

Methods such as piezo conversion and electrostatic attraction are used in inkjet method image forming apparatuses in which ink is caused to fly so as to form an image. An electrostatic method inkjet image forming apparatus shown in Japanese Patent Application Laid-open No. H11-198381 (referred to as Prior Art 1) is provided with a plurality of electrodes arranged on an ink discharge outlet side and an opposing electrode arranged in a position in opposition to leading end portions of these electrodes, and a high voltage of 1800 V for example is applied to electrodes arranged in positions near electrodes that are to form an ink discharge point at which ink is to be discharged in order to eliminate flight of ink from unintended electrodes, thereby lowering the electric potential of ink discharge points below that of electrodes arranged in nearby positions and reducing the ink at the leading ends of nearby electrodes at which ink has accumulated at the ink discharge points such that a discharge meniscus forms at the ink discharge points and ink liquid droplets are caused to fly from electrodes at the ink discharge points.

Furthermore, Japanese Patent Application Laid-open No. 2004-165587 (referred to as Prior Art 2) discloses a hyperfine liquid jet apparatus in which ink liquid droplets are discharged using an electrostatic attraction method and an electrowetting effect. The hyperfine liquid jet apparatus shown in Prior Art 2 is configured such that a flight electrode is provided inside hyperfine diameter nozzles that supply a liquid, and an electrode that covers a leading end outer side is provided outside the hyperfine diameter nozzles, and a substrate constituted by an opposing electrode is arranged at a distance of 0.05 mm or less from the leading ends of the hyperfine diameter nozzles. Then, by controlling a voltage to be applied to the electrodes provided at the leading end outer side of the hyperfine diameter nozzles and achieving an electrowetting effect, the liquid inside the hyperfine diameter nozzles moves to the opposing electrode side, and liquid droplets are caused to fly by locally increasing the strength of an electric field.

The image forming apparatus shown in Prior Art 1 requires a pulse drive device to apply a high voltage pulse voltage in order to discharge ink, which is disadvantageous in that it involves high costs and offers poor frequency responsiveness.

Furthermore, in order cause movement of the liquid using an electrowetting effect inside the hyperfine diameter nozzles, the hyperfine liquid jet apparatus shown in Prior Art 2 requires a comparatively high voltage of approximately 300 V so to be capable of creating a capillary phenomenon and to achieve resistance to enable the electrowetting effect. Furthermore, this is difficult to apply to high viscosity inks.

SUMMARY OF THE INVENTION

It is an object of the present invention to provide a liquid droplet flight device, a liquid droplet flight method, and an image forming apparatus that improves these disadvantages and enables stable flight of high viscosity inks and the like by moving inks and the like using a comparatively low voltage.

In aspect of the present invention, a liquid droplet flight device comprises a liquid droplet discharge device; and an opposing electrode arranged opposite to the liquid droplet discharge device. The liquid droplet discharge device is provided with a liquid retaining section having a liquid holding section that holds a liquid to be caused to fly, and a flight device that causes the liquid held in the liquid holding section to fly. The flight device is provided with a needle-shaped flight electrode arranged inside the liquid holding section, an electric field generating device for generating an electric field between the flight electrode and the opposing electrode, an electrowetting drive electrode (EW drive electrode) arranged inside the liquid holding section, and a flight control device for moving the liquid of the liquid holding section to the electric field generated by the flight electrode of the electric field generating device using an electrowetting phenomenon, by applying a voltage between the EW drive electrode and the liquid inside the liquid retaining section. A low voltage is applied between the EW drive electrode and the liquid inside the liquid retaining section by the flight control device while a high voltage is applied between the flight electrode and the opposing electrode by the electric field generating device, in order to cause a liquid droplet to fly onto a medium arranged between the liquid droplet discharge device and the opposing electrode.

In another aspect of the present invention, an image forming apparatus is provided with an ink droplet flight device that discharges ink droplets onto a recording medium transported on a transport path, in order to record text or images. The ink droplet flight device comprises an ink droplet discharge device and an opposing electrode arranged opposite to the ink droplet discharge device. The ink droplet discharge device is provided with an ink retaining section having an ink holding section in a slit shape or a plurality of one-dimensionally arranged pass-through holes that hold ink to be caused to fly, and a flight device for causing the ink held in the ink holding section to fly. The flight device is provided with a plurality of flight electrodes formed in a needle shape, arranged in a comb teeth manner inside the ink holding section; an electric field generating device that generates an electric field between the plurality of flight electrodes and the opposing electrode; a plurality of electrowetting drive electrodes (EW drive electrodes) arranged inside the ink holding section, corresponding to the flight electrodes; and a flight control device that moves the ink of the ink holding section to the electric field generated by the flight electrodes of the electric field generating device using an electrowetting phenomenon, by applying a voltage between the EW drive electrodes and the ink near each of the flight electrodes inside the ink retaining section. A pulse-form low voltage is applied between the EW drive electrodes and the ink near each of the flight electrodes inside the ink retaining section by the flight control device while a high voltage is applied between the flight electrodes and the opposing electrode by the electric field generating device, in order to cause ink droplets to fly onto a recording medium transported between the ink droplet discharge device and the opposing electrode.

BRIEF DESCRIPTION OF THE DRAWINGS

The above and other objects, features, and advantages of the present invention will become more apparent from the following detail description taken with the accompanying drawings, in which.

DESCRIPTION OF THE PREFERRED EMBODIMENT(s)

Hereinafter, detailed description is given of the present invention with reference to the accompanying drawings.

Figure 1:
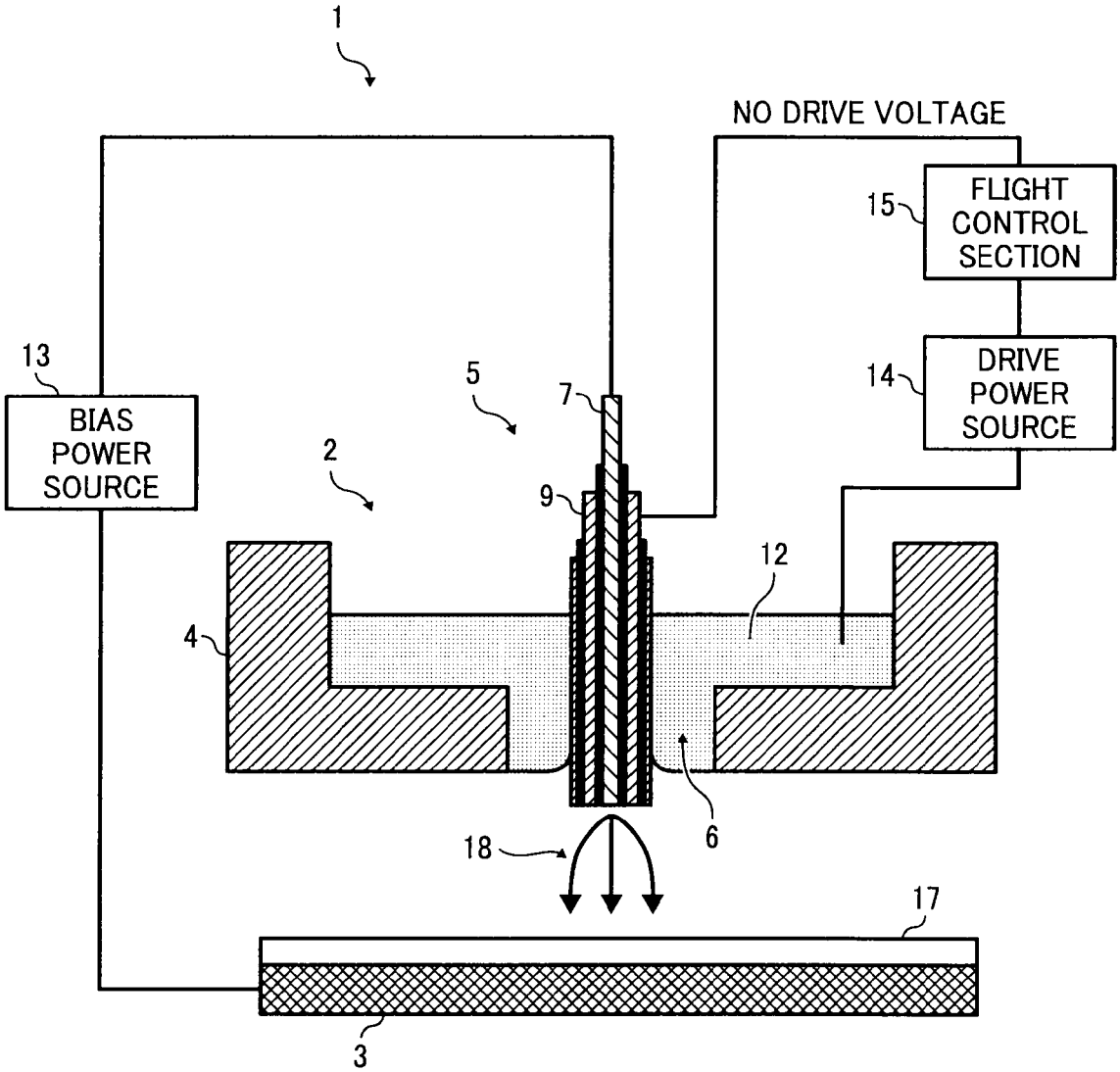
FIG. 1 is a cross-sectional view showing a configuration of a liquid droplet flight device according to the present invention.
Figure 2:
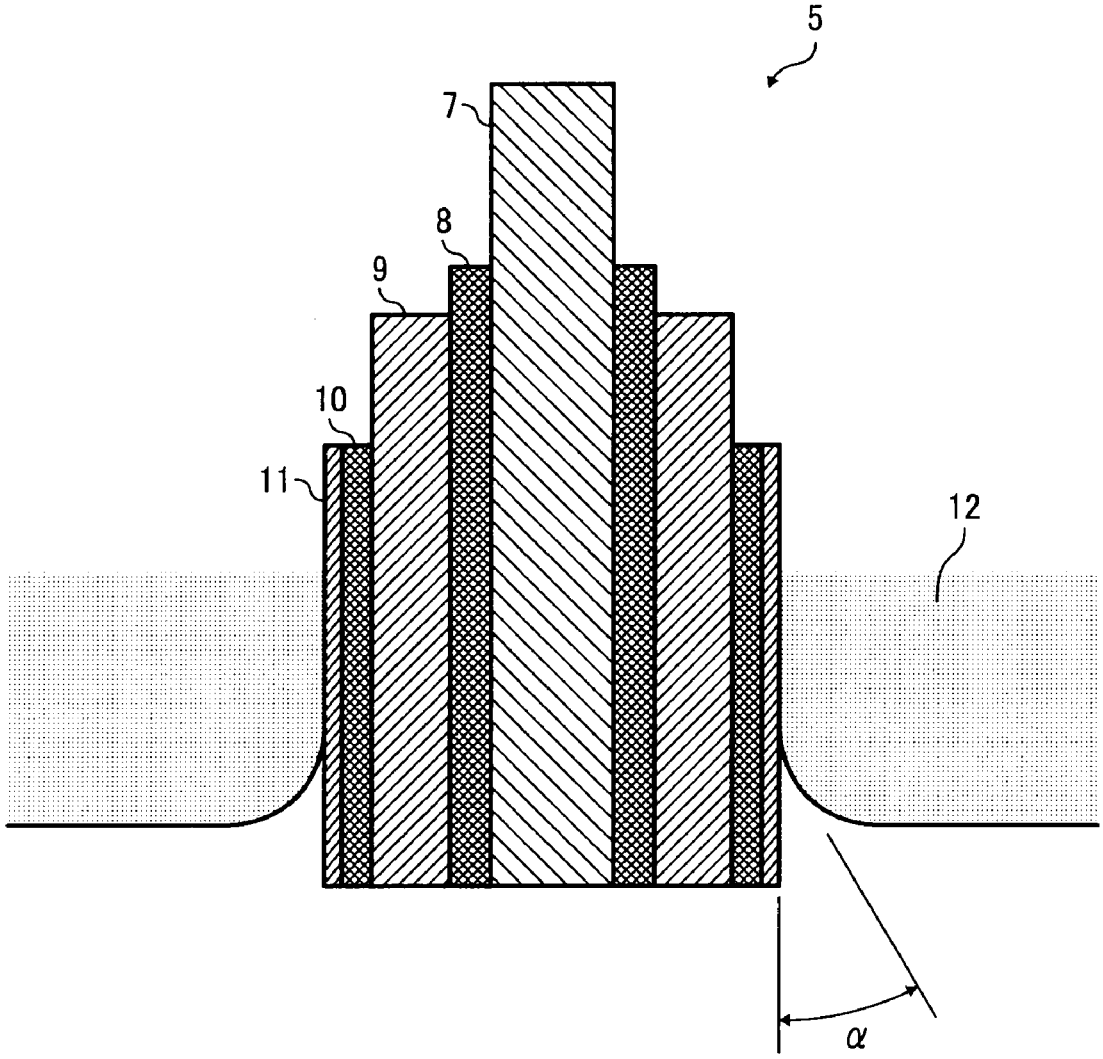
FIG. 2 is a cross-sectional view showing a configuration of electrode sections in the liquid droplet flight device.

FIG. 1 shows a configuration of a liquid droplet flight device according to the present invention. As shown in the drawing, a liquid droplet flight device 1 is provided with a liquid droplet discharge means 2, and an opposing electrode 3 arranged in opposition to the liquid droplet discharge means 2. The liquid droplet discharge means 2 is provided with a liquid retaining section 4 and a flight means 5. The liquid retaining section 4 is provided with a slit or a pass-through hole (hereinafter referred to as "slit") 6 and is formed with a material having insulating properties. As shown in the cross-sectional view of FIG. 2, the flight means 5 is provided with a rod-shaped flight electrode 7, an insulating film 8 arranged on an outer circumferential surface of the flight electrode 7, an electrowetting drive electrode (hereinafter, referred to as "EW drive electrode") 9 arranged on an outer circumferential surface of the insulating film 8, an insulating film 10 that covers an outer circumferential surface of the EW drive electrode 9, and a water-repellent film 11 arranged on an outer circumferential surface of the insulating film 10, and a leading edge portion thereof is arranged inside the slit 6 so as to protrude slightly from the slit 6 of the liquid retaining section 4. A liquid-absorbing material such as a sponge for example may also be provided in the slit 6.

The flight electrode 7 is a material having conductive properties and anti-discharge properties, for example, copper and tungsten, or a carbon or the like, and is formed having an outer diameter of 0.005 to 0.03 mm, for example, 0.015 mm. The EW drive electrode 9 is a material having good conductive properties, for example, copper and tungsten, or a carbon or the like, and is formed having a thickness of 0.001 to 0.005 mm, for example, 0.001 mm. The flight electrode 7 and the EW drive electrode 9 are formed using an etching or spattering method, or a CVD method. The insulating film 8 and the insulating film 10 are materials having good insulating properties and anti-discharge properties, for example, $SiO_2$, and are formed having a thickness of 0.001 to 0.005 mm, for example, 0.001 mm. The water-repellent film 11 is formed with a fluorine-based resin for example. A high-viscosity liquid 12 having insulating properties, for example an ink having a viscosity of 8 mPa·s or more, is retained in the liquid retaining section 4, and the width of the slit 6 is determined in accordance with an outer diameter of the flight electrode 7, and in a case where the outer diameter of the flight electrode 7 is 0.015 mm, and for example is formed to approximately 0.2 mm so as to be capable of ensuring a flow channel cross-sectional area sufficient for replenishing ink that has flown. The opposing electrode 3 is formed with a material having good conductive properties, copper for example, and is arranged leaving a space of 0.01 to 0.5 mm from the leading edge of the flight electrode 7, for example 0.2 mm.

Figure 3:
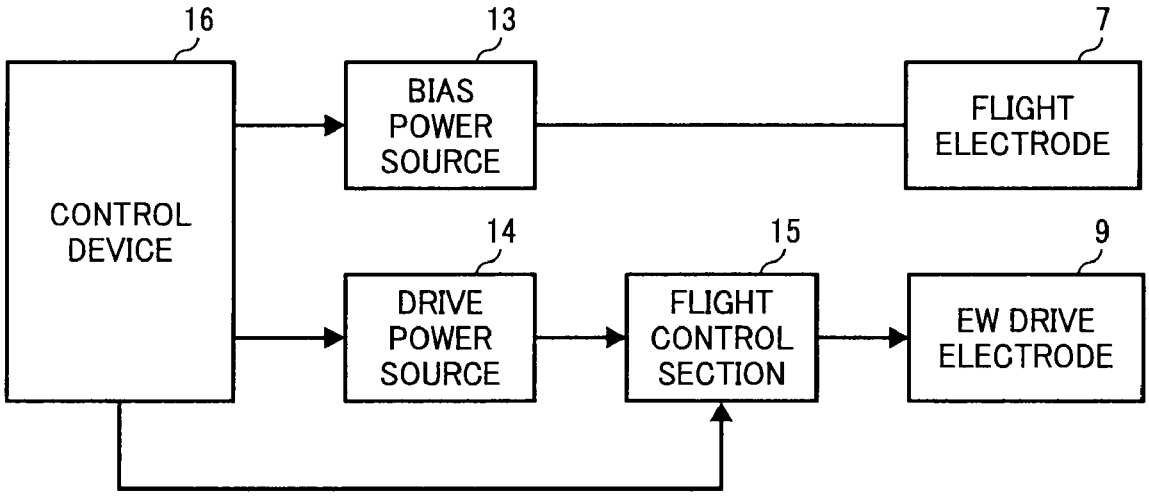
FIG. 3 is a block diagram showing connections of a control device to power sources and flight control means.

The flight electrode 7 is connected to the opposing electrode 3 via a bias power source 13, and a high voltage bias voltage of approximately 2 kV for example is applied to it from the bias power source 13. The EW drive electrode 9 is connected to the liquid 12 of the liquid retaining section 4 via a drive power source 14 and a flight control means 15, and a low voltage drive voltage of 100 V or less is applied to it. The bias power source 13, the drive power source 14, and the flight control means 15 are controlled by a control device 16 as shown in the block diagram of FIG. 3.

Figure 4:
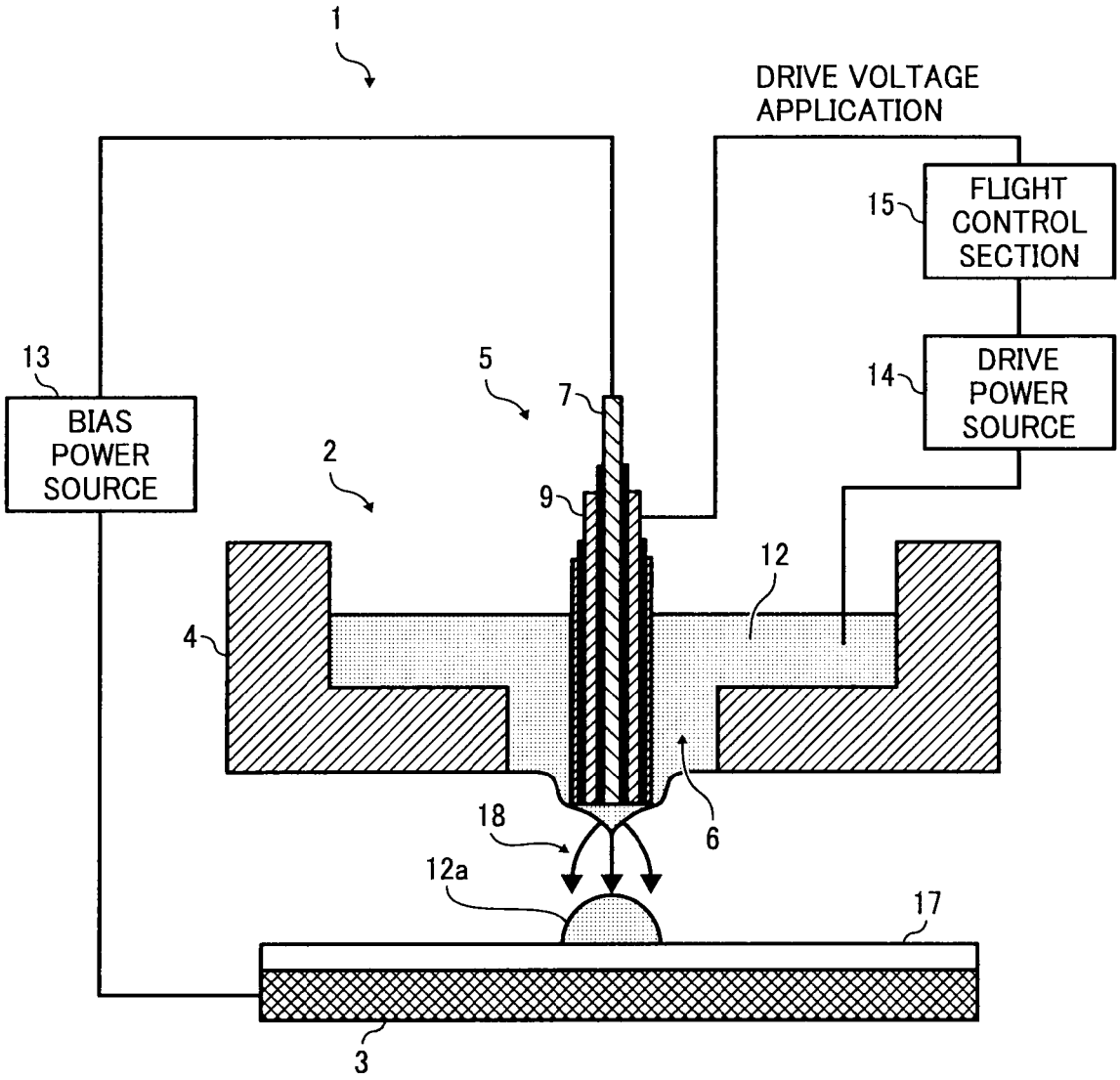
FIG. 4 is a cross-sectional view showing a state in which a liquid droplet has been caused to fly by the liquid droplet flight device.

When liquid droplets of the liquid 12 inside the liquid retaining section 4 are caused to fly to a medium 17 that is transported between the liquid droplet discharge means 2 and the opposing electrode 3 in the liquid droplet flight device 1, the control device 16 applies a high voltage to the flight electrode 7 from the bias power source 13 such that an electric field 18 is produced between the flight electrode 7 and the opposing electrode 3 as shown in FIG. 1. At this time, a slit 6 side surface of the liquid 12 inside the slit 6 of the liquid retaining section 4 is positioned inside the slit 6, which is outside an electric field 18 of the flight electrode 7 due to a meniscus produced due a water-repellent effect of the water-repellent film 11 of the flight means 5. In this state, the control device 16 performs on/off control on the flight control means 15 and applies a low voltage drive voltage to the EW drive electrode 9 from the drive power source 14. When the drive voltage is applied to the EW drive electrode 9, the liquid 12 inside the slit 6 moves to the leading edge portion of the flight electrode 7 as shown in FIG. 4 due to an electrowetting phenomenon. That is, when a drive voltage is applied between the EW drive electrode 9 and the liquid 12 inside the liquid retaining section 4, thereby applying an electric charge to charge the liquid 12, the surface tension of the liquid 12 is reduced so as to improve the wetness properties with the water-repellent film 11, and the surface of the liquid 12 inside the slit 6 moves to the leading edge portion of the flight electrode 7. Since a high electric field is being produced between the leading edge portion of the flight electrode 7, which is to where the surface of the liquid 12 has moved, and the opposing electrode 3, the liquid 12 that has moved to the leading edge portion of the flight electrode 7 flies toward the opposing electrode 3 through this electric field such that a liquid droplet 12*a* lands on the medium 17.

In this manner, by merely performing on/off control on the drive voltage applied to the EW drive electrode 9, a low voltage of 100 V or less for example, a liquid droplet 12*a* of the liquid 12 inside the liquid retaining section 4 can be caused to fly, and a low cost can be achieved for the liquid droplet flight device 1 by simplifying the configuration of the flight control means 15.

Furthermore, by applying a drive voltage to the flight electrode 7 to move the liquid 12 inside the slit 6 to the leading edge portion of flight electrode 7 using an electrowetting phenomenon, a high viscosity liquid 12 can be caused to fly stably.

Figure 5A:
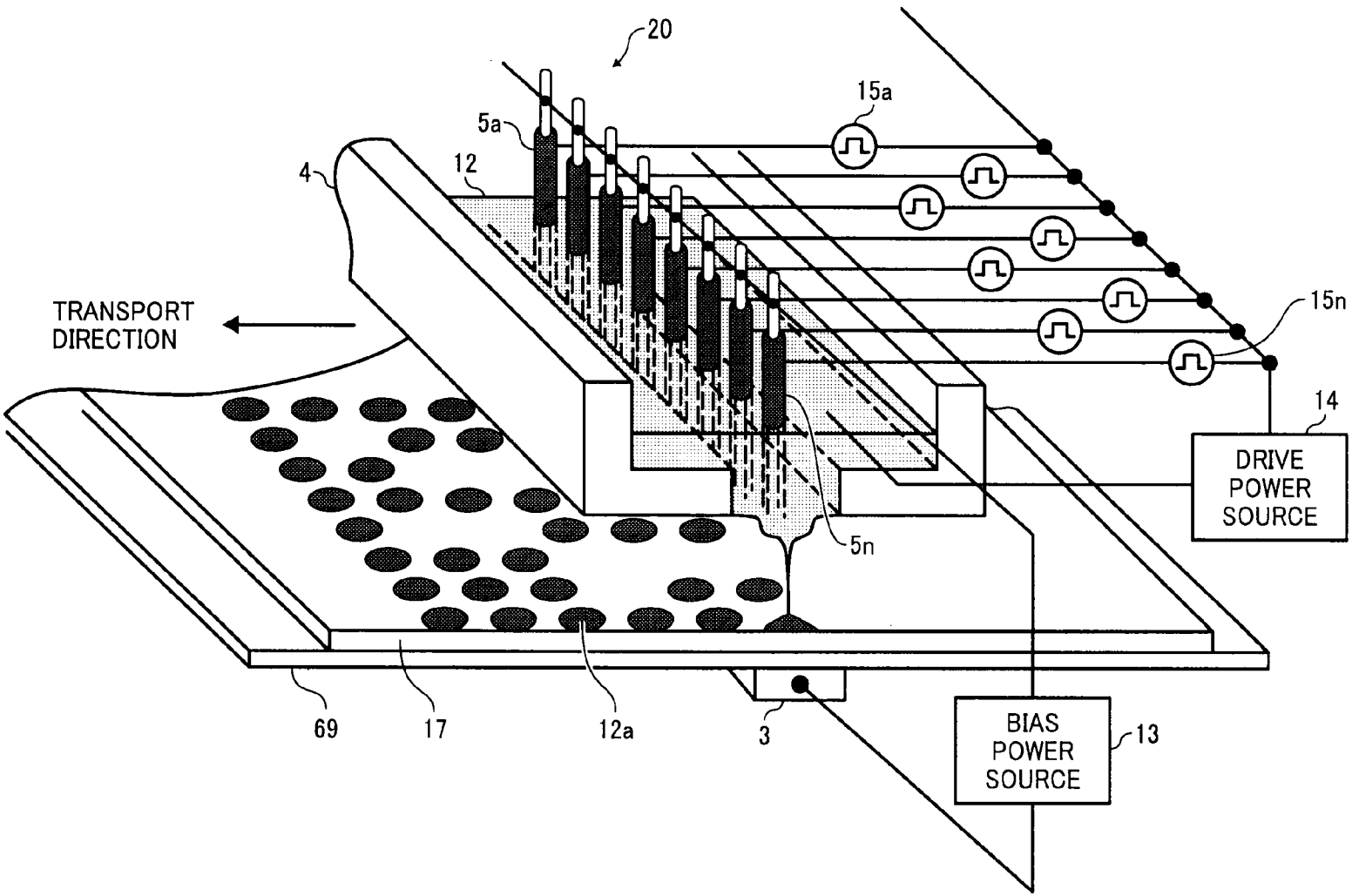
FIGS. 5A and 5B are diagrams showing configurations of a one-dimensional discharge unit.
Figure 5B:
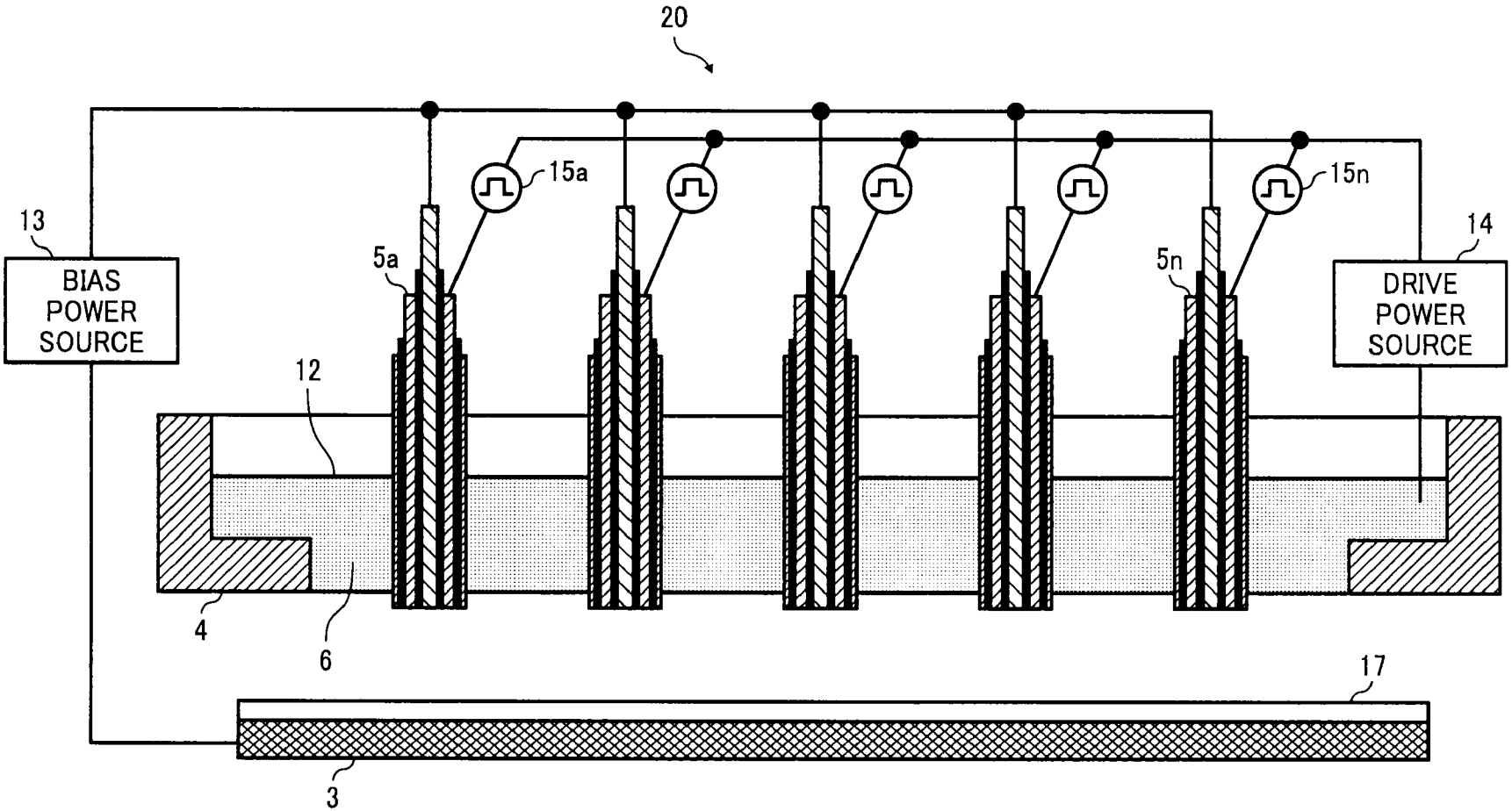

Description is given regarding an image forming apparatus in which the liquid droplet flight device 1 is used. As shown in FIGS. 5A and 5B, the image forming apparatus is provided with a one-dimensional discharge unit 20 in which a plurality of flight means 5*a* to 5*n* are arranged in a comb teeth manner at an image resolution pitch in the liquid retaining section 4 of the slit 6 of the liquid droplet flight device 1. The opposing electrode 3 is arranged in opposition to the leading edge portions of the pointed flight electrodes 7 of the flight means 5*a* to 5*n*, and a recording paper 17 is supplied that is transported by a transport belt 68 between the flight electrodes 7 and the opposing electrode 3. And the flight electrodes 7 of the flight means 5*a* to 5*n* are connected to the bias power source 13, and the EW drive electrodes 9 are connected to the drive power source 14 via respective flight control sections 15*a* to 15*n*, such that ink 12 is charged near where the corresponding flight electrodes 7 are arranged. Trailing edge portions, which are not arranged in the liquid retaining section 4, of the flight electrodes 7 of the plurality of flight means 5*a* to 5*n* are integrally linked. These linked flight electrodes 7 may be formed using etching to have uniform microscopic intervals.

Figure 6:
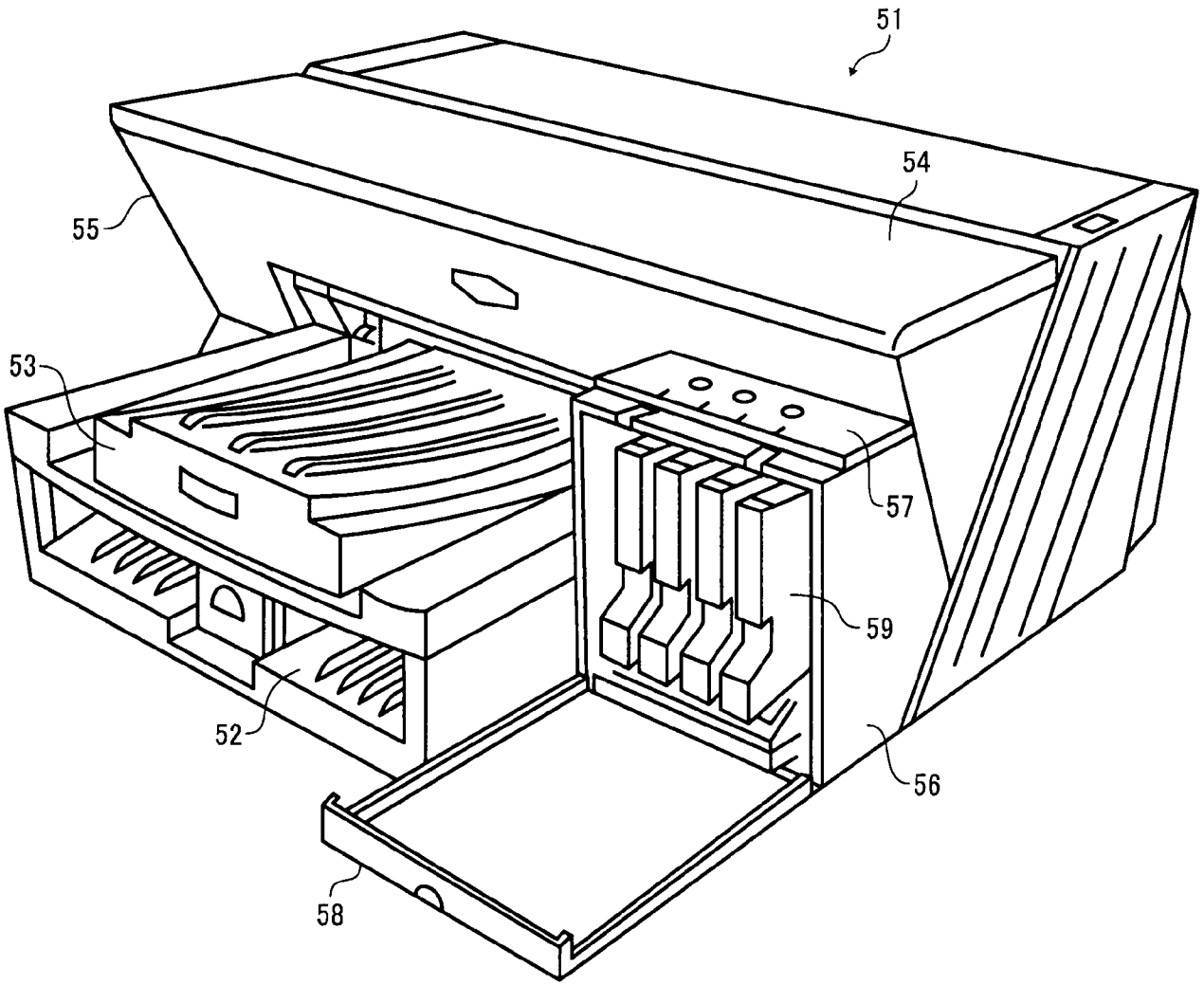
FIG. 6 is a perspective view showing a configuration of an image forming apparatus in which a present invention is applied.

As shown in the perspective drawing of FIG. 6, an image forming apparatus 51 provided with the one-dimensional discharge unit 20 is provided with a paper supply tray 52, which is mounted on the apparatus main unit and accommodates recording papers, and a paper discharge tray 53, which is mounted on the apparatus main unit and stacks recording papers on which images have been recorded. An openable/closeable upper cover 54 is provided on an upper side of the apparatus main unit. Furthermore, a cartridge loading section 56 is provided at one end portion of a front surface 55 of the apparatus main unit protruding forwardly and at a lower position than the upper cover 54, and an operation section 57 including operation keys and a display device and the like is provided above the cartridge loading section 56. An openable/closeable front cover 58 is provided at a front surface of the cartridge loading section 56 and by opening the front cover 58, ink cartridges 59, which are the main tanks for replenishing ink, can be removed and attached.

Figure 7A:
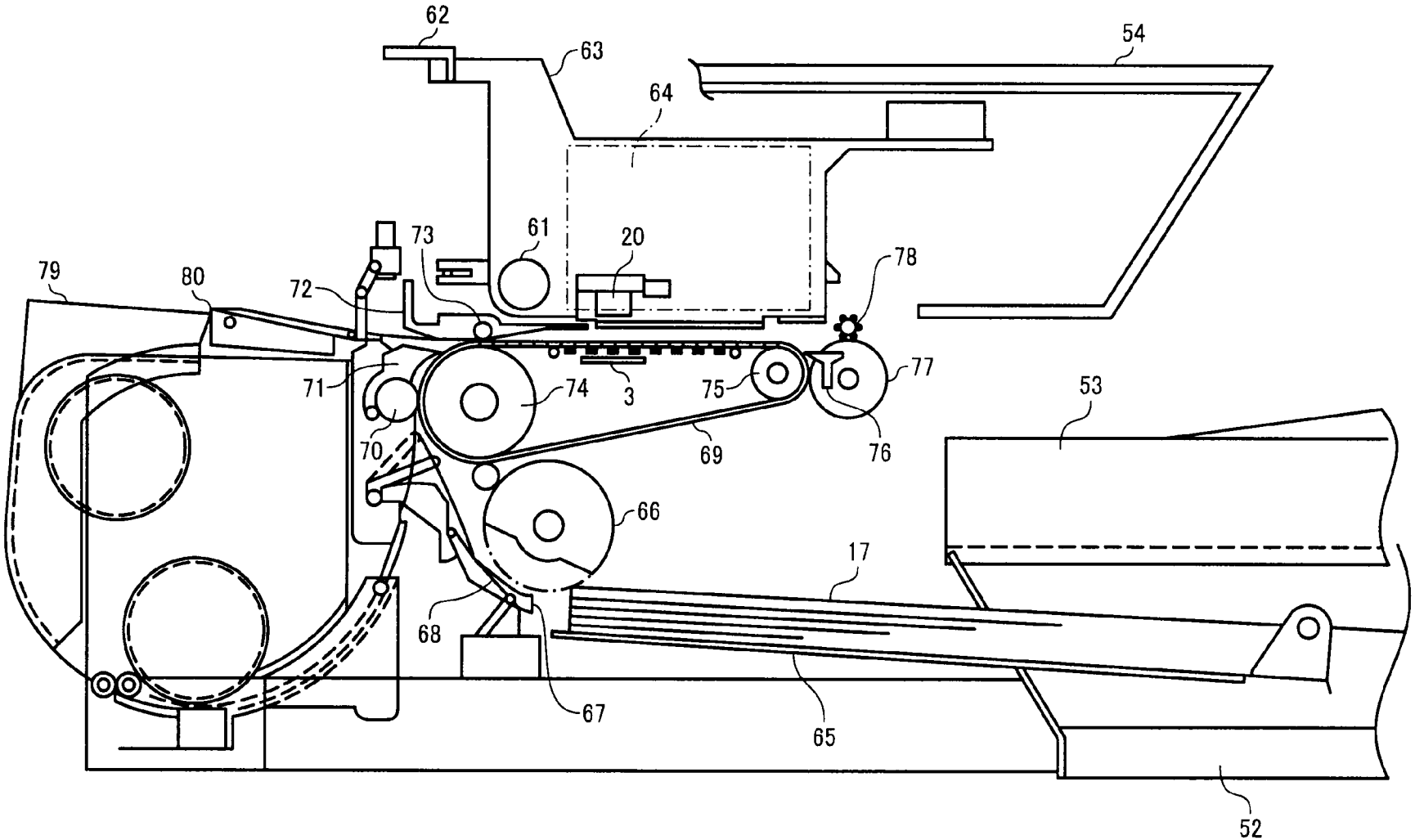
FIGS. 7A and 7B are diagrams showing configurations of mechanical portions of the image forming apparatus.
Figure 7B:
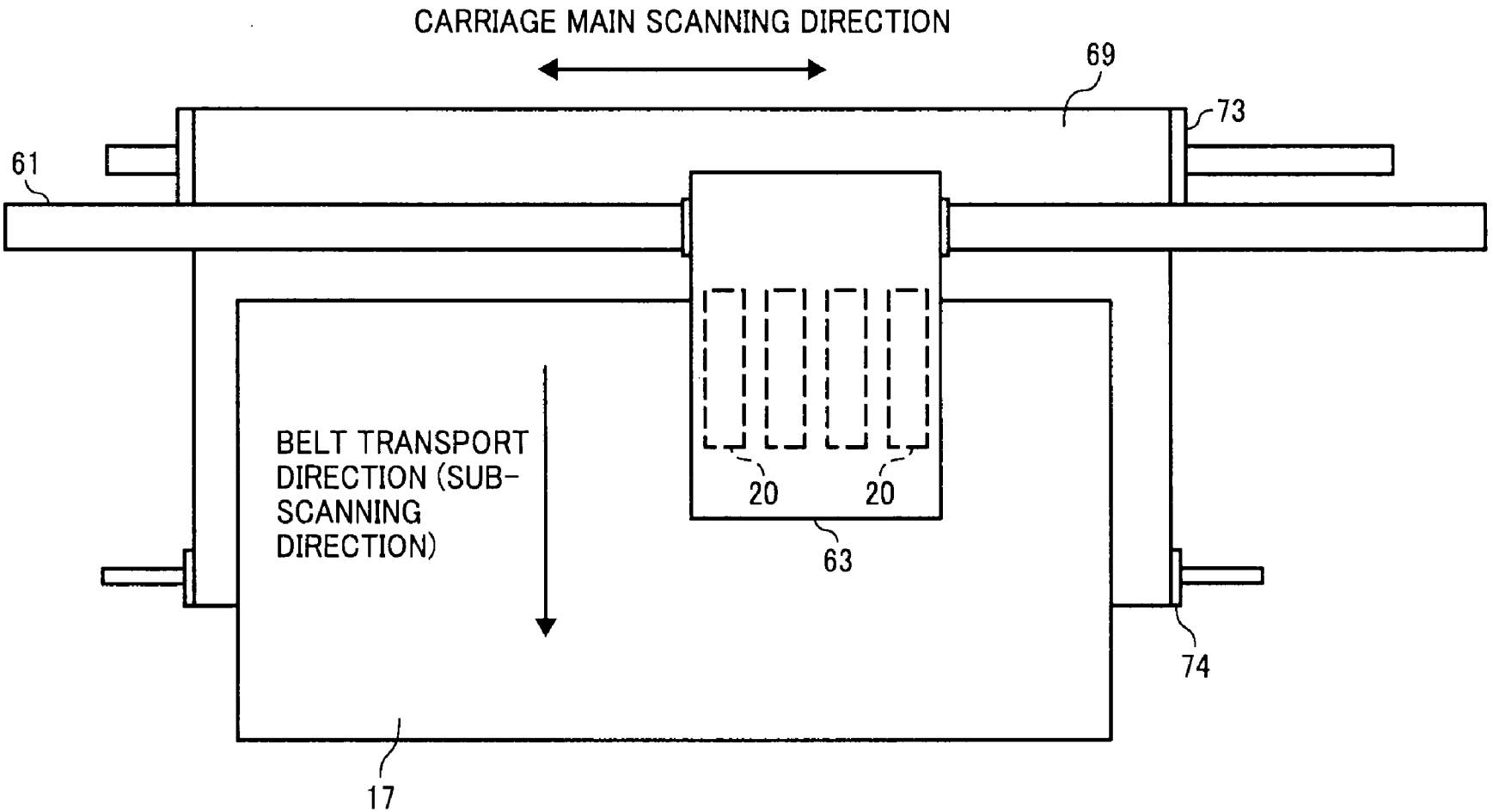
Figure 8A:
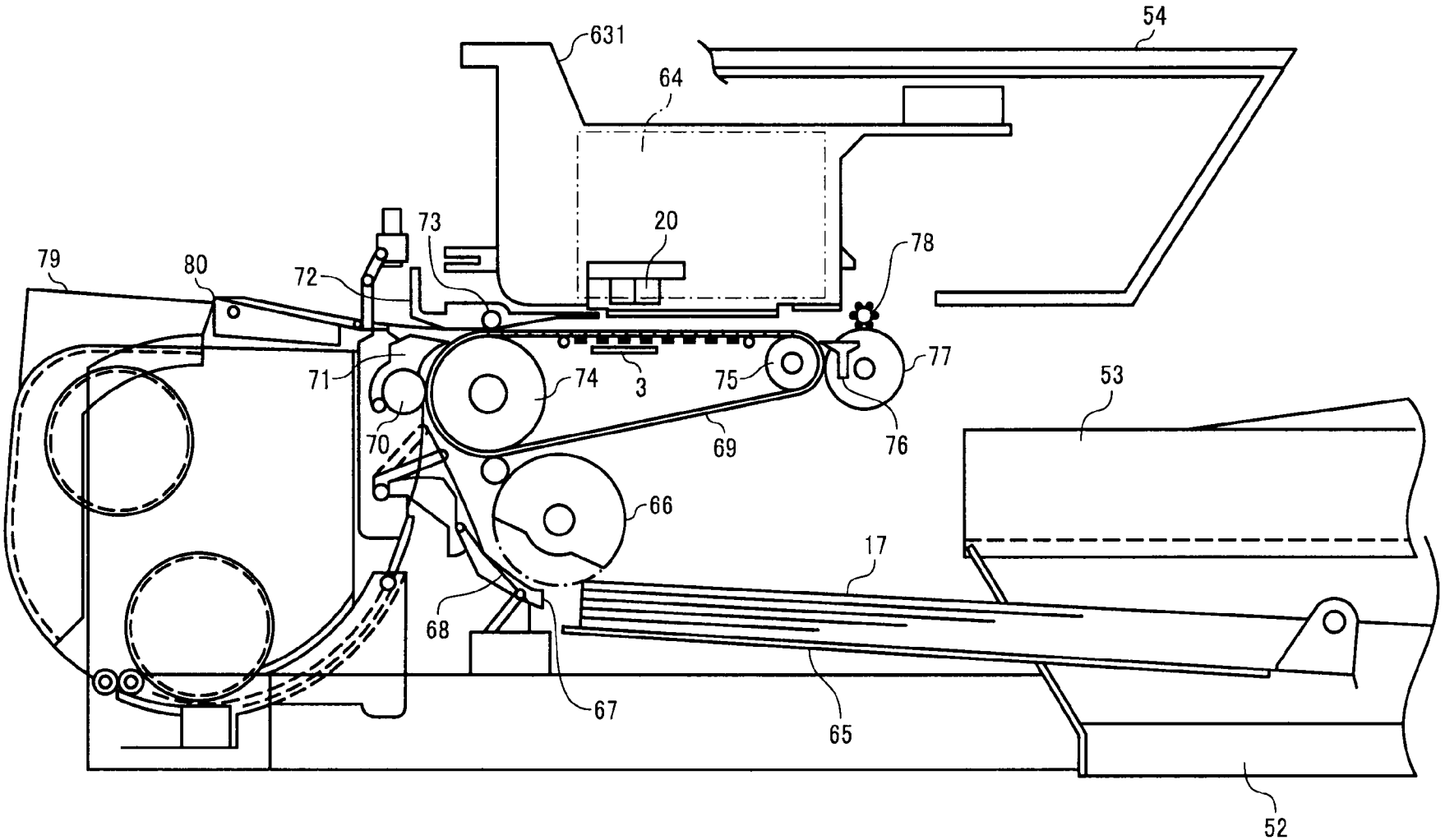
FIGS. 8A and 8B are diagrams showing configurations of other mechanical portions of the image forming apparatus.
Figure 8B:
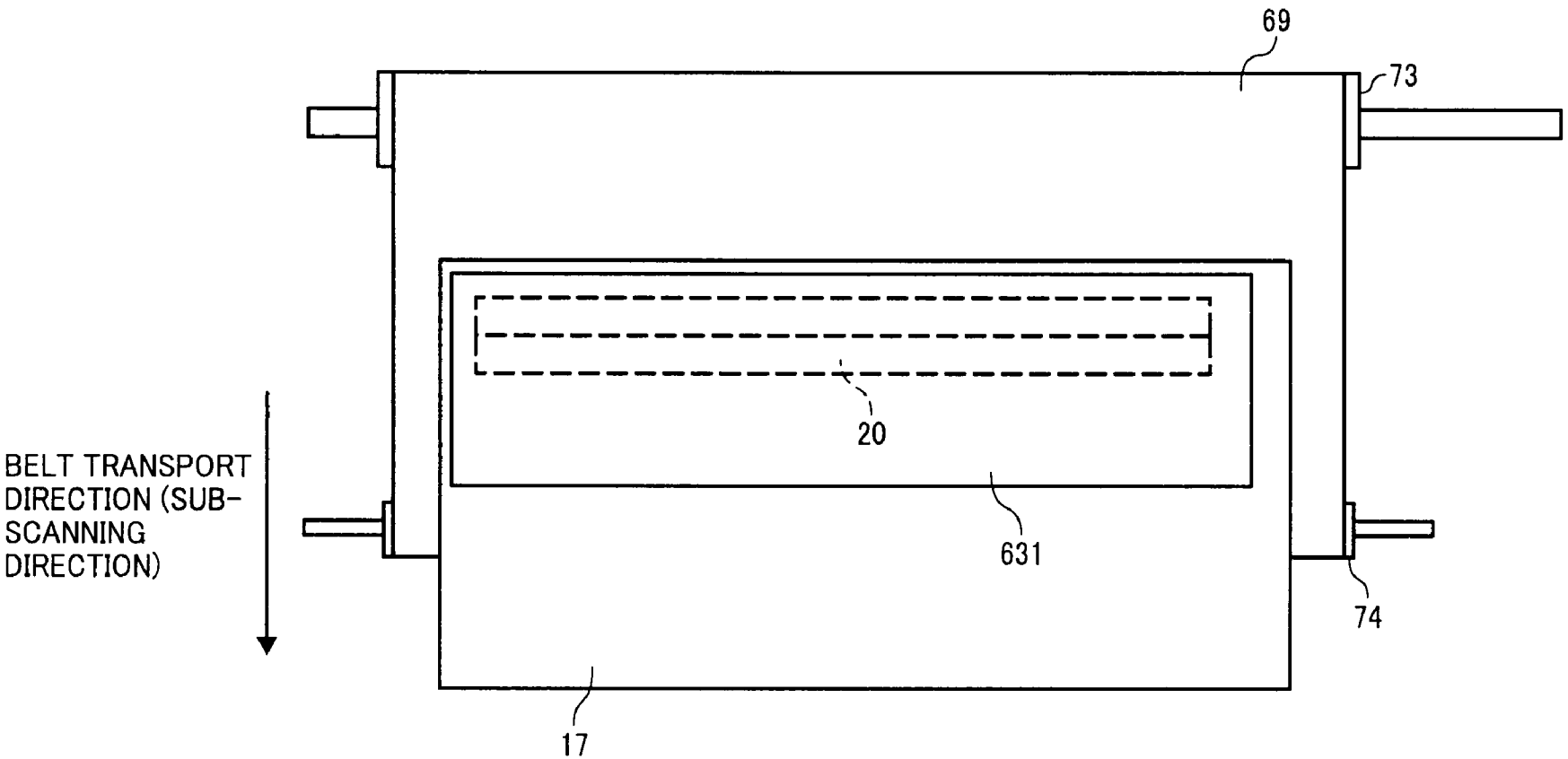

The mechanical portion of the image forming apparatus 51 may use either a carriage movement method or a line head method. As shown in the lateral structural diagram of FIG. 7A and the top view structural diagram of FIG. 7B, the mechanical portion of a carriage movement method involves a carriage 63 being slidably supported in a main scanning direction by a guide rod 61, which is a guiding member extending laterally between side panels of the apparatus main unit 51, and a stay 62, and being moved and scanned in a carriage main scanning direction by a main scanning motor. Mounted in the carriage 63 are four one-dimensional ink discharge units 20 that cause flight of ink droplets of each of the colors yellow (Y), cyan (C), magenta (M), and black (Bk) used in the liquid droplet flight device 1. Furthermore, sub tanks 64 are mounted in the carriage 63, which are liquid containers of each color for supplying ink of each of the colors to the one-dimensional discharge units 20. Ink is replenished and supplied to the sub tanks 64 from each the ink cartridges 59. As shown in the lateral structural diagram of FIG. 8A and the top view structural diagram of FIG. 8B, the mechanical portion of a line head method involves a single or multiple one-dimensional discharge units 20 having a width corresponding to the paper width of the recording paper 17 being arranged in an array in a head holder 631 to perform printing while the recording paper 17 is moved at a constant velocity.

A crescent shaped roller (paper supply roller) 66, which separates and feeds the recording papers 17 sheet by sheet from a paper loading section 65, and a separating pad 67, which faces the paper supply roller 66, is constituted by a material having a large friction coefficient, and applies bias toward the paper supply roller 66, are provided as a paper supply section for supplying the recording papers 17 loaded on the paper loading section (pressing board) 65 of the paper supply tray 52. And provided as a transport section for transporting the recording papers 17 supplied from the paper supply tray 52 below the one-dimensional discharge units 20 from the guide 68 are: a transport belt 69 for transporting the recording papers 17, a counter roller 70 for transporting the recording papers 17 sent via the guide 67 from the paper supply section sandwiched against the transport belt 69, a transport guide 71 for performing direction conversion of approximately 90 degrees on the recording paper 17 that has been sent substantially vertically to align with the transport belt 69, and a leading edge pressure roller 73 that biases the transport belt 69 using a pressing member 72. Furthermore, an opposing electrode 3 that is in opposition to each of the flight means 5 of the one-dimensional ink discharge units 20 is arranged at a rear side of the transport belt 69. The transport belt 69 is an endless belt and is constructed so as to rotate around and span between a transport roller 74 and a tension roller 75. The transport belt 69 has a two layer structure, and the inner side thereof may have a metal conductive member such as nickel. Furthermore, when a high voltage is applied from the transport roller 74 to the conductive member of the transport belt 69, this may be used instead of the opposing electrode 3.

A separating claw 76 for separating the recording paper 17 from the transport belt 69, a discharge roller 77, and a discharge small roller 78 are provided as a discharge section for discharging the recording papers 17 that have been recorded on by the one-dimensional discharge units 20, and a paper discharge tray 53 is provided under the discharge roller 77. Furthermore, a double-side paper supply unit 79 is attachably mounted at a rear surface portion of the apparatus main unit 51. The double-side paper supply unit 79 rotates in a reverse direction to the transport belt 69 to take in and turn over the recording paper 17 that has been returned and resend it to the transport belt 69. A manual paper feeding section 80 is arranged on an upper surface of the double-side paper supply unit 79.

When printing is performed on the recording paper 17 in the image forming apparatus, the drive voltages applied to the EW drive electrodes 9 of the flight means 5*a* to 5*n* of the one-dimensional discharge unit 20 are turned on and off by their respective flight control sections 15*a* to 15*n* in response to the image data to be printed, thereby causing ink droplets 12*a* to fly due to the electric field produced by the predetermined flight electrodes 7 such that [the ink droplets] land and are recorded on the recording paper 17 as shown in FIG. 5A. The speed of operation when causing the ink droplets 12*a* to fly depends on the speed the ink 12 moves to leading end portions of the flight electrodes 7 due to the electrowetting phenomenon when the drive voltages are applied to the EW drive electrodes 9. The movement speed of the ink 12 varies depending on the viscosity of the ink 12, but in a case where 0.1 msec is required to move 100 μm for example, the corresponding printing speed is 120 ppm, thus allowing high speeds to be achieved.

Since the one-dimensional discharge unit 20 is configured in this manner with a liquid retaining section 4 having a slit 6 and a plurality of flight means 5*a* to 5*n*, it is possible to achieve a simple structure that is compact and lightweight, and it is also possible to improve reliability and durability since a movable drive section and a heating section are not required.

Furthermore, since the liquid retaining section 4 is used jointly among the plurality of flight means 5*a* to 5*n* to form the ink flow channel including the slit 6 of the liquid retaining section 4, high viscosity inks can be stably supplied into the slit 6 and it is possible to achieve greater speeds in printing and higher image quality.

Furthermore, since it is unnecessary to provide a separate liquid chamber for each of the plurality of flight means 5*a* to 5*n*, production is easier and yields at the time of production can be improved. Further still, since the liquid retaining section 4 is not divided into separate liquid chambers, the liquid retaining section 4 can be used as the ink flow channel and high viscosity inks can be stably and continuously supplied, thereby enabling greater speeds in printing to be achieved.

Furthermore, by arranging at least two rows of the one-dimensional discharge unit 20 in parallel in a direction orthogonal to the slit 6, it is possible to support a greater number of dots and higher speeds.

Further still, by arranging at least two rows of the one-dimensional discharge unit 20 such that their phases are shifted by a half pixel in the direction of the slit 6, higher density [printing] can be achieved.

Figure 9:
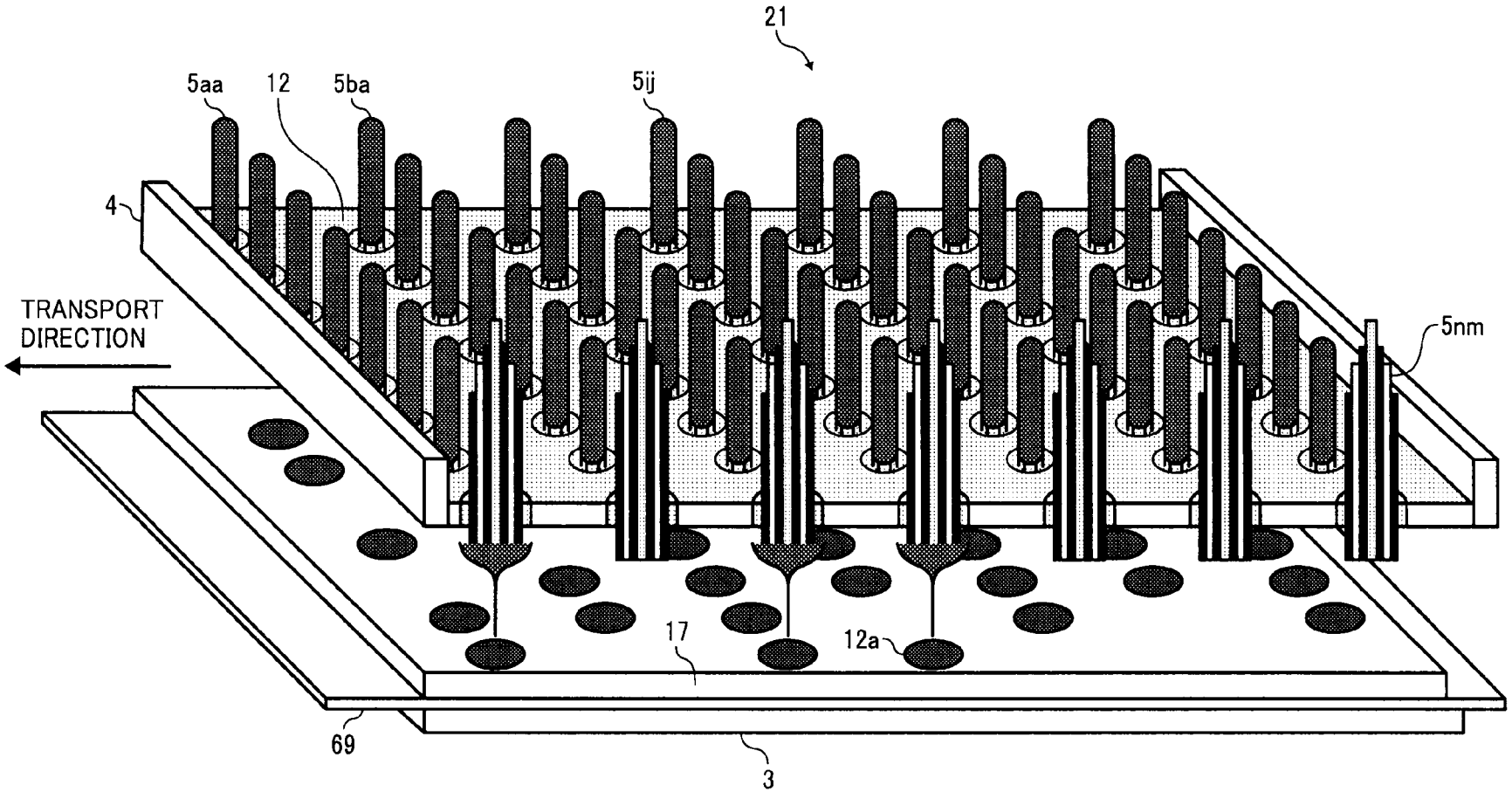
FIG. 9 is a perspective diagram showing a configuration of a two-dimensional discharge unit.

In the foregoing description, description was given regarding a case where the one-dimensional discharge unit 20 was used in an image forming apparatus, but as shown in the perspective drawing of FIG. 9, a two-dimensional discharge unit 21 may be used in which a plurality of flight means 5*ij* (i=a to n, j=a to m) are arranged two-dimensionally.

In an image forming apparatus in which the two-dimensional discharge unit 21 is used, the recording paper 17 is transported while drive voltages are applied by flight control sections 15*ij* to EW drive electrodes 9 of a plurality of flight means 5*ij* in response to image data to achieve flash printing, thereby enabling even greater printing speeds to be achieved. For example, in a case where the transport speed of the recording paper 17 is 1 m/sec, the corresponding printing speed is 286 ppm, enabling printing to be performed at high speed.

Figure 10:
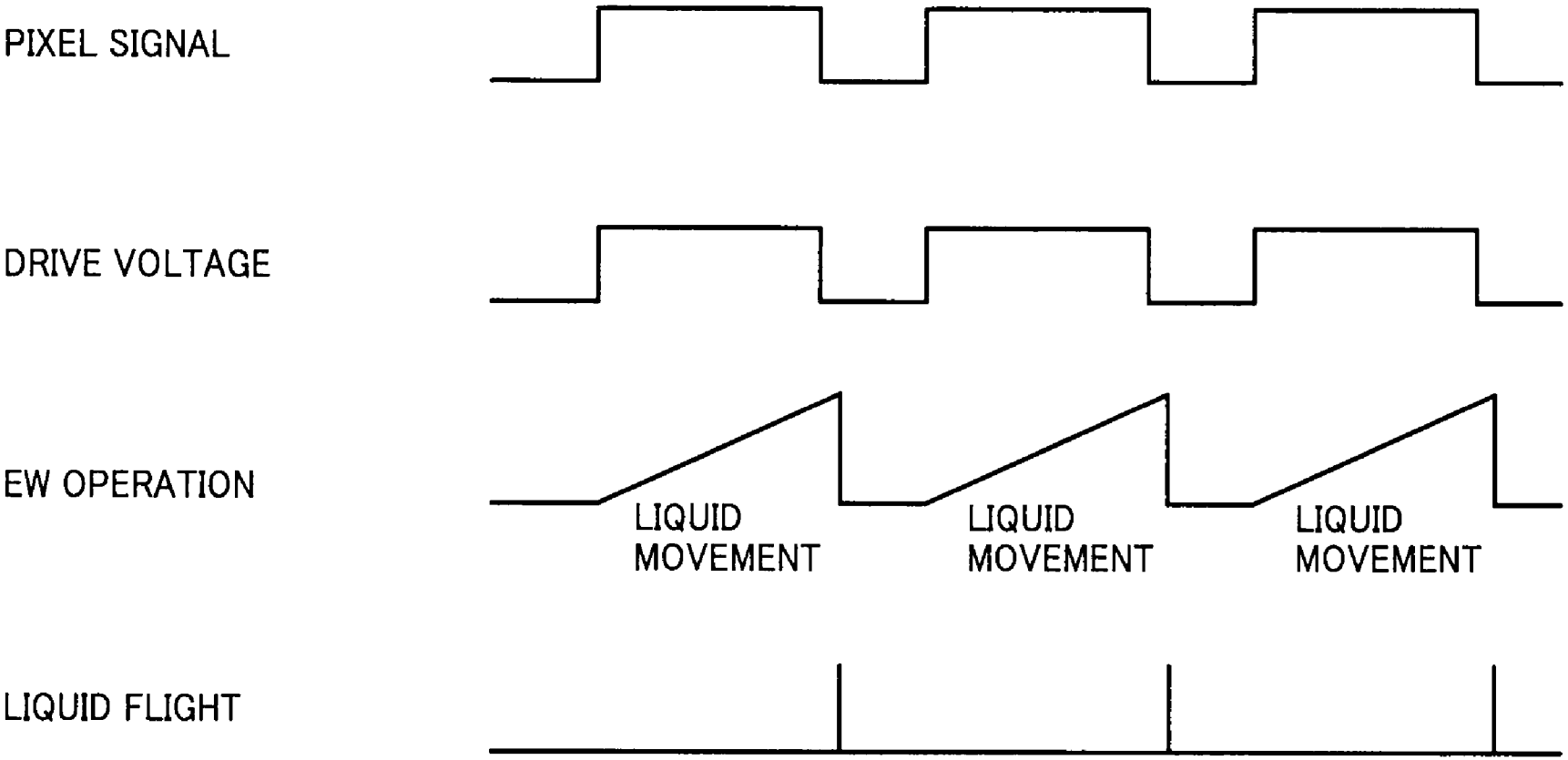
FIG. 10 is a waveform diagram showing an operation when an ink droplet is caused to fly.

Furthermore, when the viscosity of the ink 12 is high, the speed of the ink 12 becomes slower in moving to the leading end portion of the flight electrode 7 due to the electrowetting phenomenon when the drive voltage is applied to the EW drive electrode 9. Even though the movement speed of the ink 12 is slower, the ink droplets 12*a* fly due to the electric field produced by the flight electrode 7 when the ink 12 moves to the leading end portion of the flight electrode 7 due to the electrowetting phenomenon by the inputting of a pixel signal to the drive voltage to the EW drive electrode 9 as shown in the waveform diagram of FIG. 10, and therefore when the speed of the ink 12 in moving to the leading end portion of the flight electrode 7 is 210 msec for example, a printing speed is possible of approximately 286 ppm, thus allowing high speed printing even when using the high viscosity ink 12.

Figure 11A:
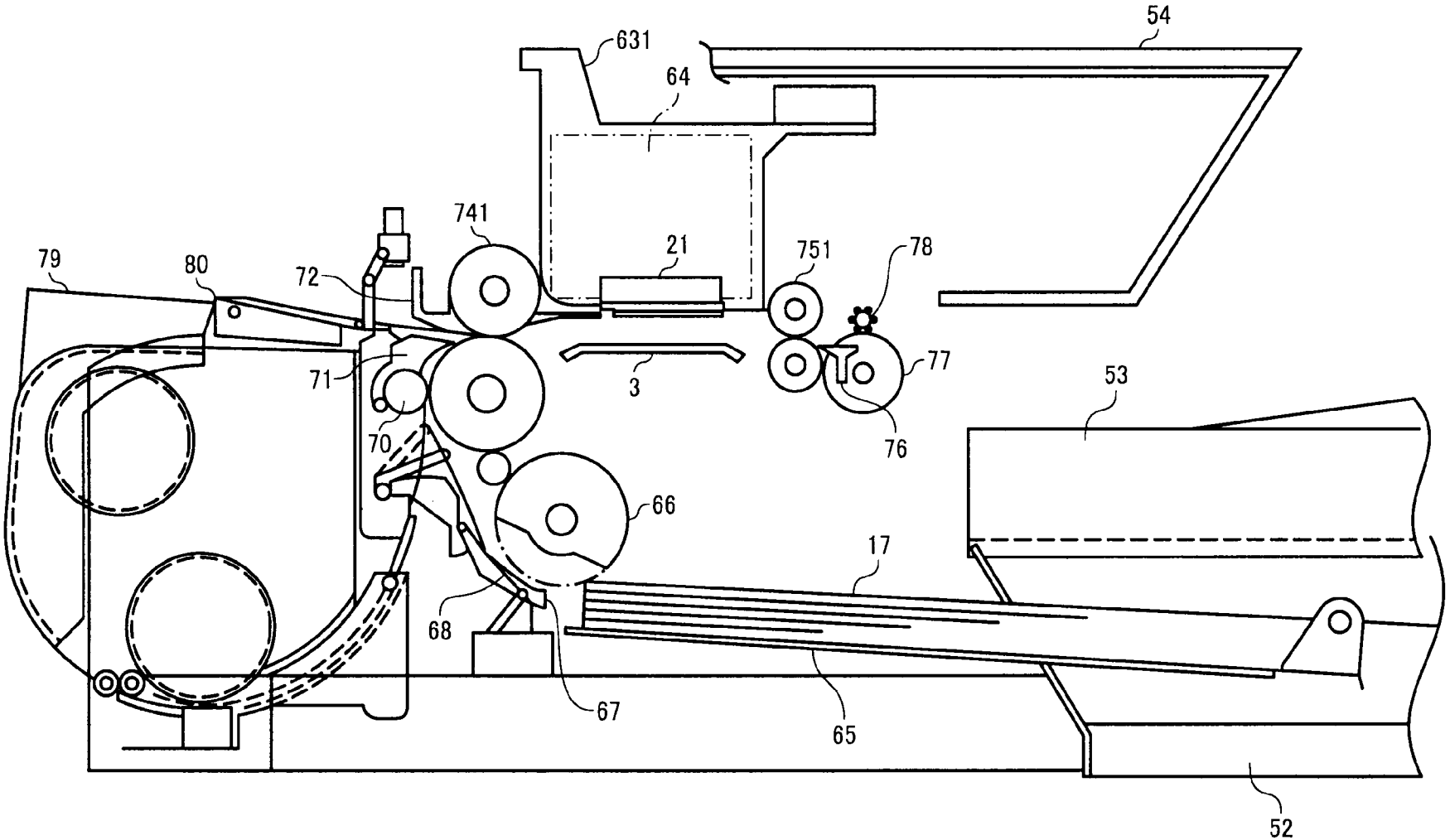
FIGS. 11A to 11C are diagrams showing configurations of other image forming apparatuses.
Figure 11B:
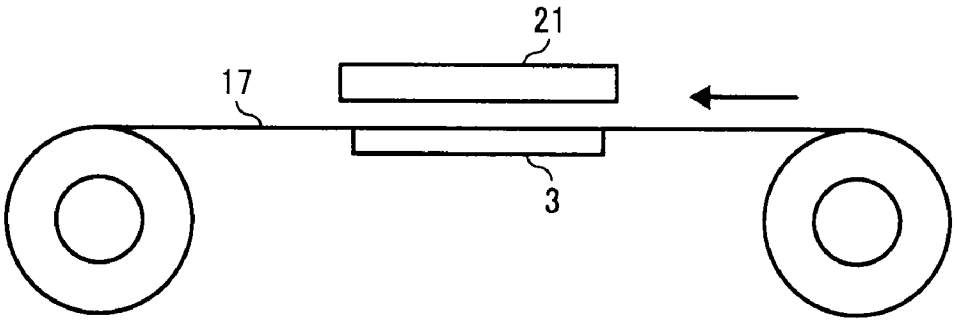
Figure 11C:
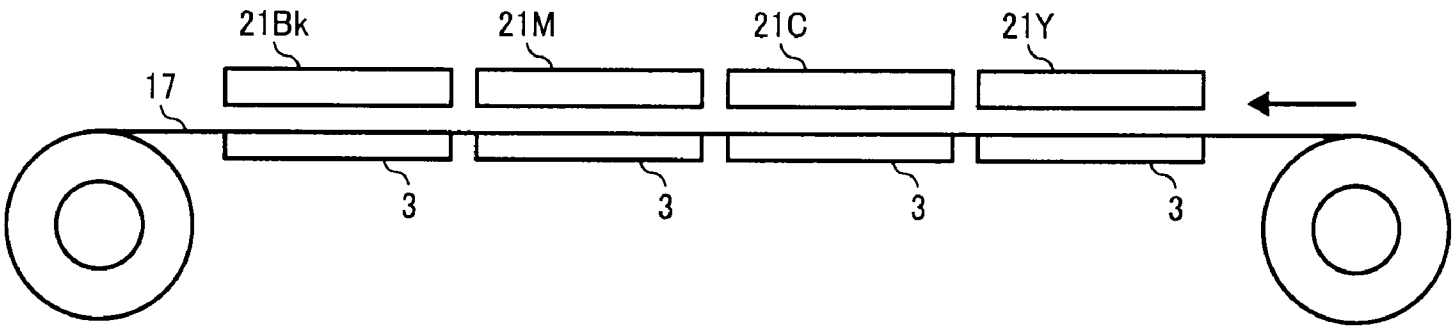

Furthermore, by providing the two-dimensional discharge unit 21 on a transport path on which the recording paper 17 is transported by a pair of transport rollers 741 and a pair of tension rollers 751 arranged before and after a recording region as shown in the lateral configuration diagram of the structural sections of the image forming apparatus 51 in FIG. 11A, and using the opposing electrode 3 that faces the two-dimensional discharge unit 21 as a transport guide, it is possible to print an image on the recording paper 17 at high speed. Furthermore, by arranging the two-dimensional discharge unit 21 on the transport path of a roll shaped recording paper 17 as shown in FIG. 11B, or, as shown in FIG. 11C, by arranging two-dimensional discharge units 21Y, 21C, 21M, and 21Bk of the colors yellow (Y), cyan (C), magenta (M), and black (Bk) on the transport path of the roll shaped recording paper 17, it is possible to print a single color image or a full color image at high speed while also achieving compactness in the image forming apparatus.

Figure 12:
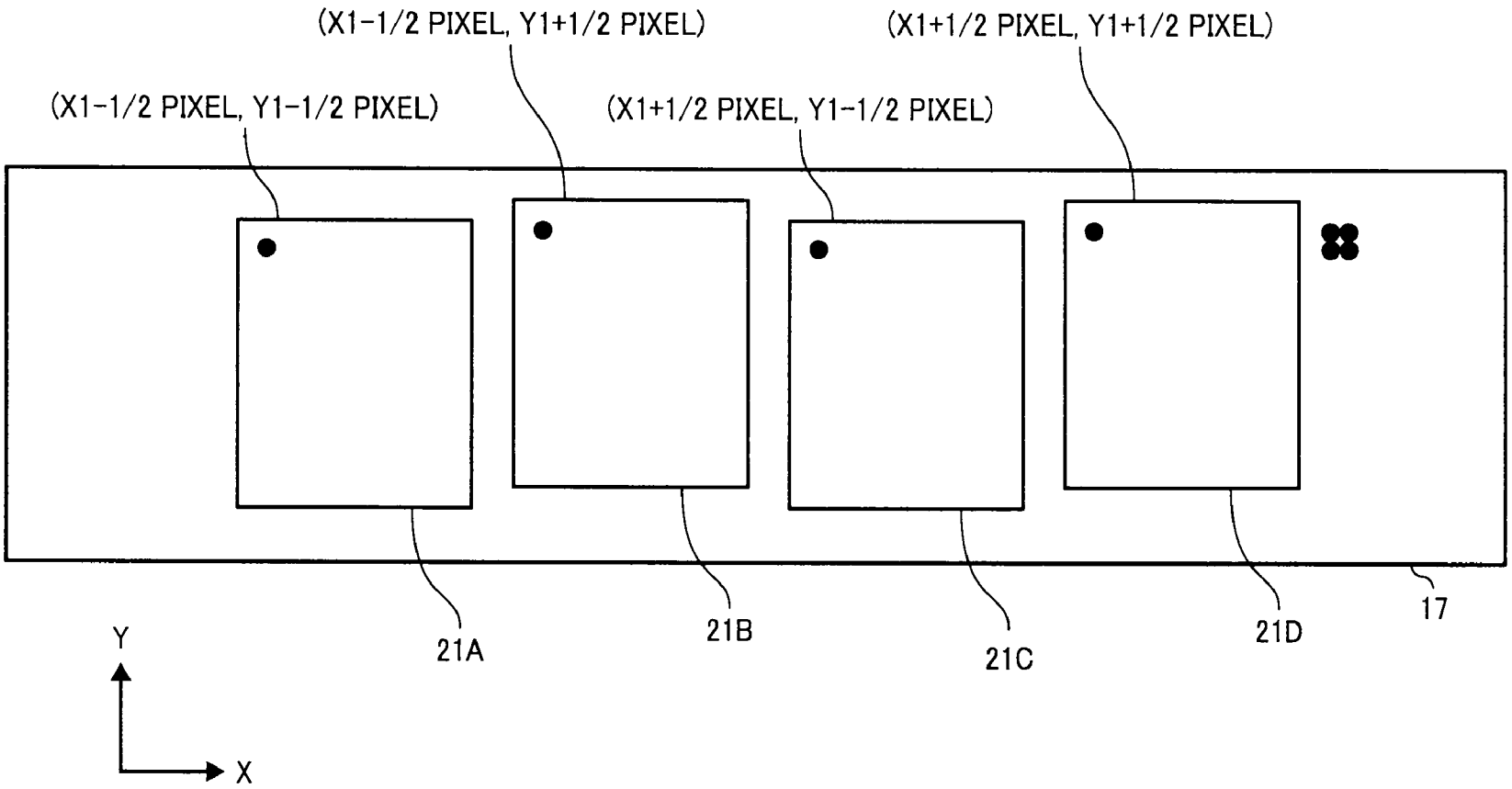
FIG. 12 is a diagram showing another arrangement of a two-dimensional discharge unit with respect to a roll shaped recording paper.

Further still, as shown in FIG. 12, by providing for example four two-dimensional discharge units 21A to 21D on the transport path of a roll paper recording paper 17 and, with respect to a reference position (x1, y1), arranging the first two-dimensional discharge unit 21A shifted by −½ pixel in the X direction and the Y direction for example, then arranging the second two-dimensional discharge unit 21B shifted −½ pixel in the X direction and +½ pixel in the Y direction, then arranging the third two-dimensional discharge unit 21C shifted +½ pixel in the X direction and −½ in the Y direction, and arranging the fourth two-dimensional discharge unit 21D shifted +½ pixel in the X direction and +½ pixel in the Y direction, then applying drive voltages to the four two-dimensional discharge units 21A to 21D using the same pixel signal, a pixel density of 600 dpi for example can be increased in density to 1,200 dpi.

Figure 13:
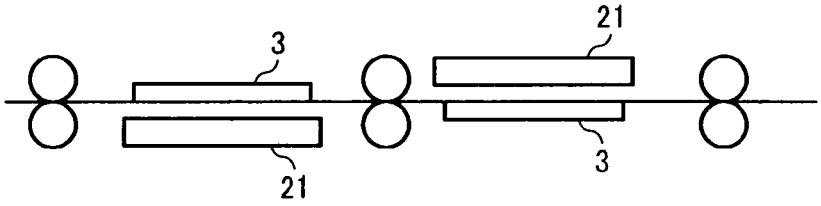
FIG. 13 is a diagram showing an arrangement of two-dimensional discharge units provided on a front and rear of a transport path of the recording paper.

Furthermore, by alternately arranging two-dimensional discharge units 21 on a front side and a rear side along the transport direction of the transport path of the recording paper 17 as shown in FIG. 13, the recording paper 17 can be printed continuously on both sides, thereby enabling improved printing efficiency. Further still, by alternately arranging the two-dimensional discharge units 21Y, 21C, 21M, and 21Bk of the colors yellow (Y), cyan (C), magenta (M), and black (Bk) on the front side and the rear side of the transport path of the recording paper 17, it is possible to ensure a drying time for the ink that has flown onto the recording paper 17.

Figure 14A:
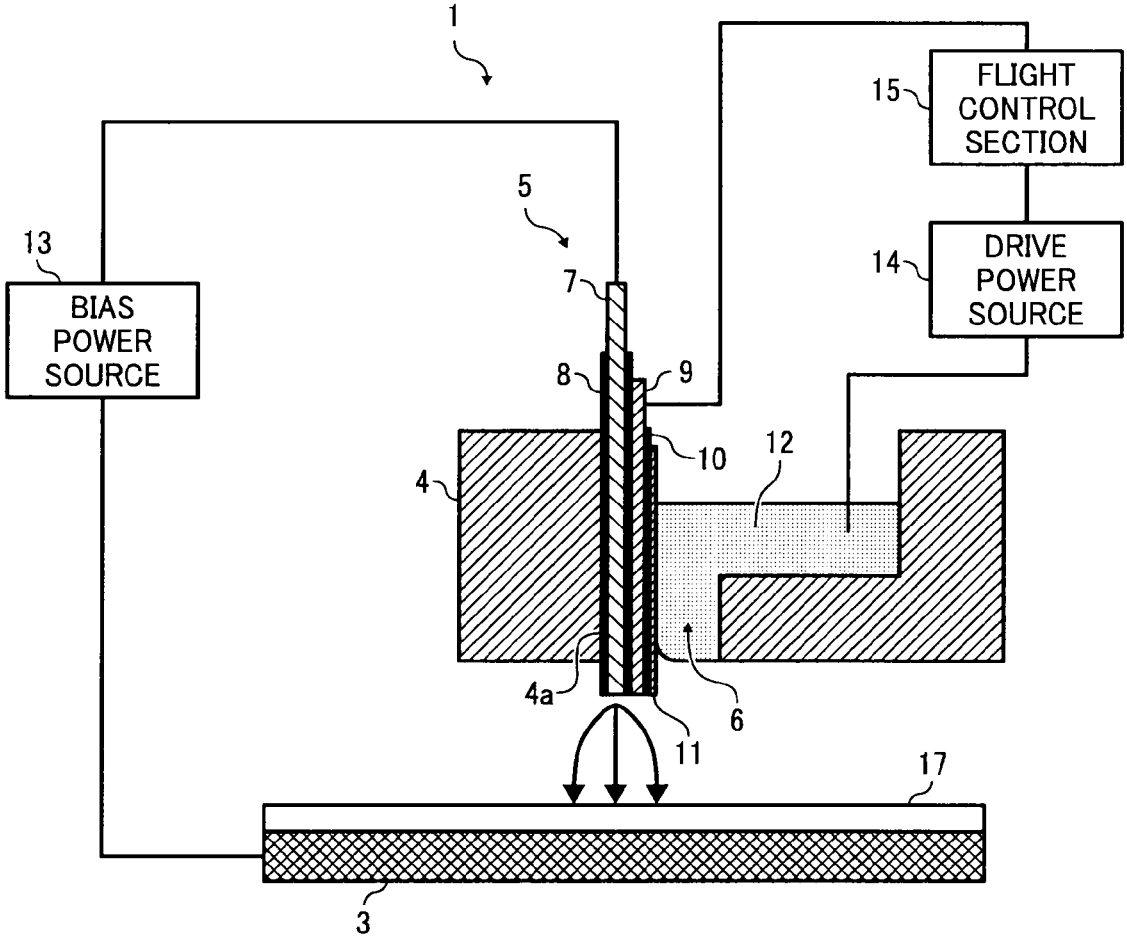
FIGS. 14A and 14B are cross-sectional views showing configurations of a second liquid droplet flight device.
Figure 14B:
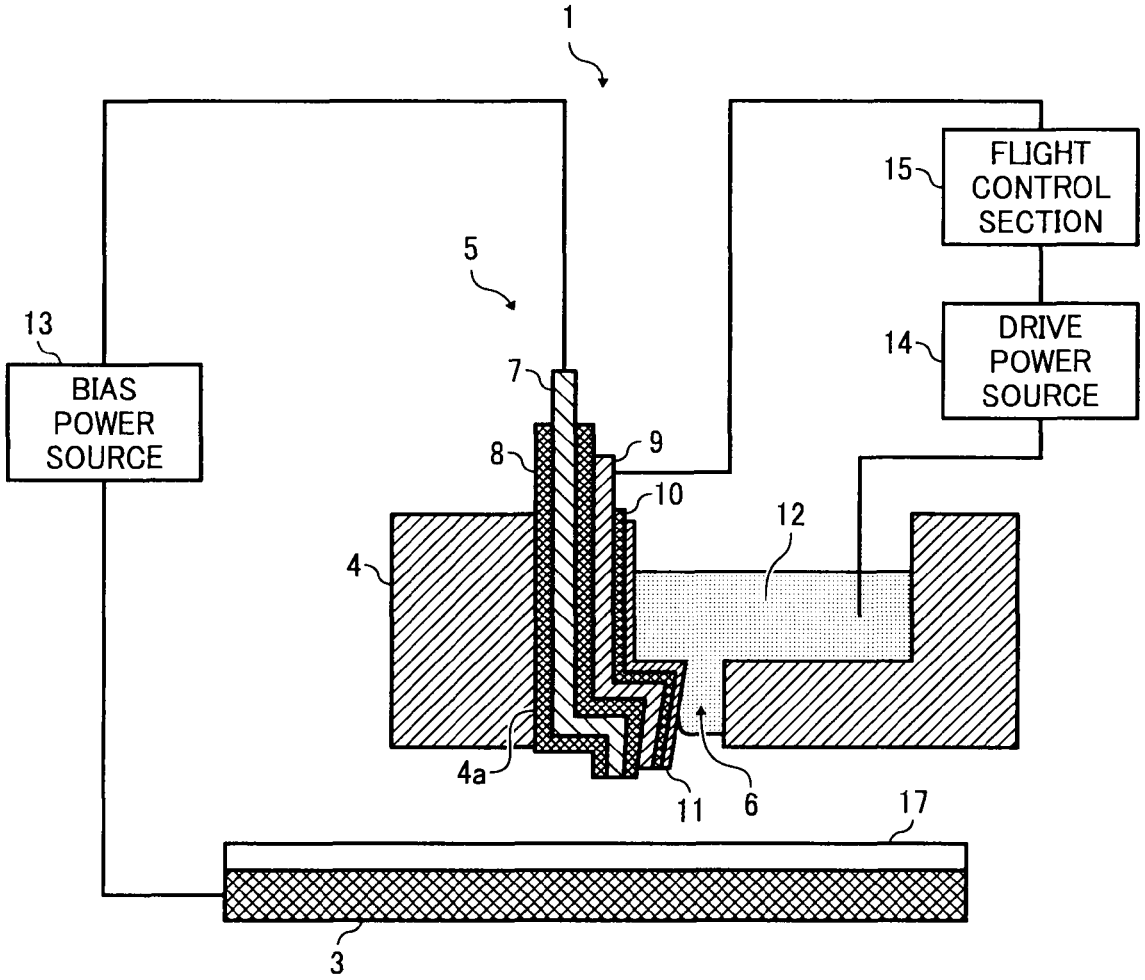

In the foregoing description, description was given regarding a case where the flight means 5 of the liquid droplet discharge means 2 was provided independent from the liquid retaining section 4, but as shown in the cross-sectional views of FIGS. 14A and 14B, the flight means 5 may be arranged along a wall surface 4*a* that forms the slit 6 of the liquid retaining section 4 such that the flight means 5 is integrated with one side of the wall surface 4*a* of the liquid retaining section 4. In this case, the EW drive electrode 9 is provided in a region of half of an outer circumferential surface of the insulating film 8 that covers an outer circumferential surface of the flight electrode 7, and an outer circumferential surface of the EW drive electrode 9 is covered by the insulating film 10 and the water-repellent film 11, then a region of the insulating film 8 covering the outer circumferential surface of the flight electrode 7 where the EW drive electrode 9 is not provided is secured along the wall surface 4*a* of the side where the slit 6 of the liquid retaining section 4 is formed.

By providing the flight means 5 in this manner along the wall surface 4*a* of the side where the slit 6 of the liquid retaining section 4 is formed, the flight means 5 can be held stably, and the flight means 5 can be held simply.

Here, FIG. 14A shows a case where the flight electrode 7 is entirely aligned with the wall surface 4*a* where the slit 6 of the liquid retaining section 4 is formed, and FIG. 14B shows a case where the leading end portion of the flight electrode 7 that produces the electric field is apart by a fixed interval from the wall surface 4*a* where the slit 6 of the liquid retaining section 4 is formed. As shown in FIG. 14B, by setting apart the leading end portion of the flight electrode 7 that produces the electric field from the wall surface 4*a*, the electric field that is produced can be better stabilized.

Figure 15:
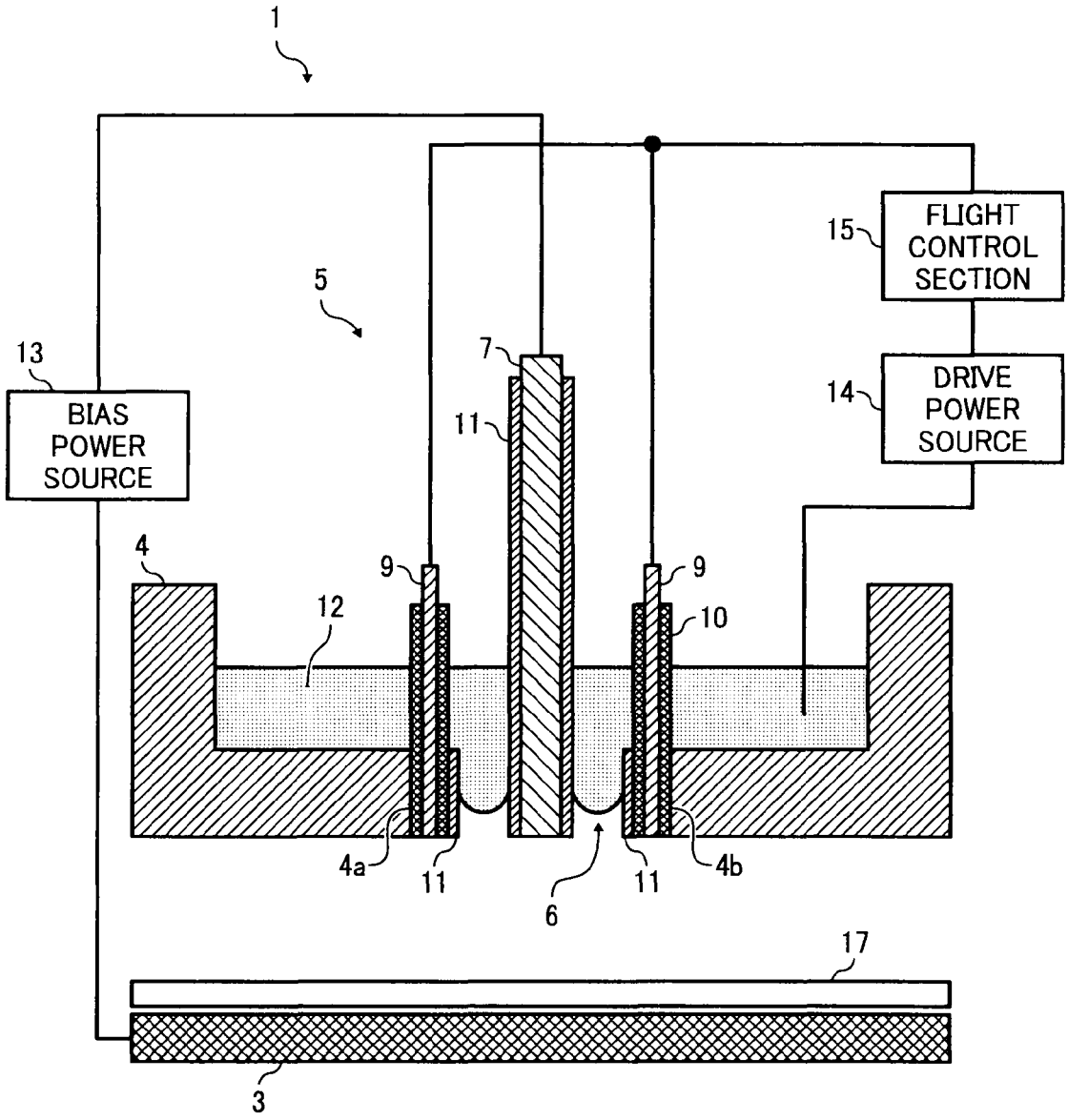
FIG. 15 is a cross-sectional view showing a configuration of a third liquid droplet flight device.

In the foregoing descriptions, description was given regarding a case where the flight means 5 of the liquid droplet discharge means 2 was formed integrally with the flight electrode 7 and the EW drive electrode 9, but as shown in FIG. 15, the flight electrode 7 may be arranged inside the slit 6 of the liquid retaining section 4 with outer circumferential surfaces thereof covered by the water-repellent film 11, and the EW drive electrodes 9 may be provided in portions corresponding to the flight electrode 7 at both wall surfaces 4*a* and 4*b* where the slit 6 of the liquid retaining section 4 is formed. In this case, the outer circumferential surfaces of the EW drive electrodes 9 may be covered by the insulating film 10 and [areas] other than attachment surfaces of the insulating film 10 to the wall surfaces 4*a* and 4*b* may be covered by the water-repellent film 11.

By providing the EW drive electrodes 9 on both wall surfaces 4*a* and 4*b* where the slit 6 of the liquid retaining section 4 is formed in this manner, the ink 12 can be moved very efficiently to the leading end portion of the flight electrode 7 using the electrowetting phenomenon and printing speeds can be further increased.

Figure 16:
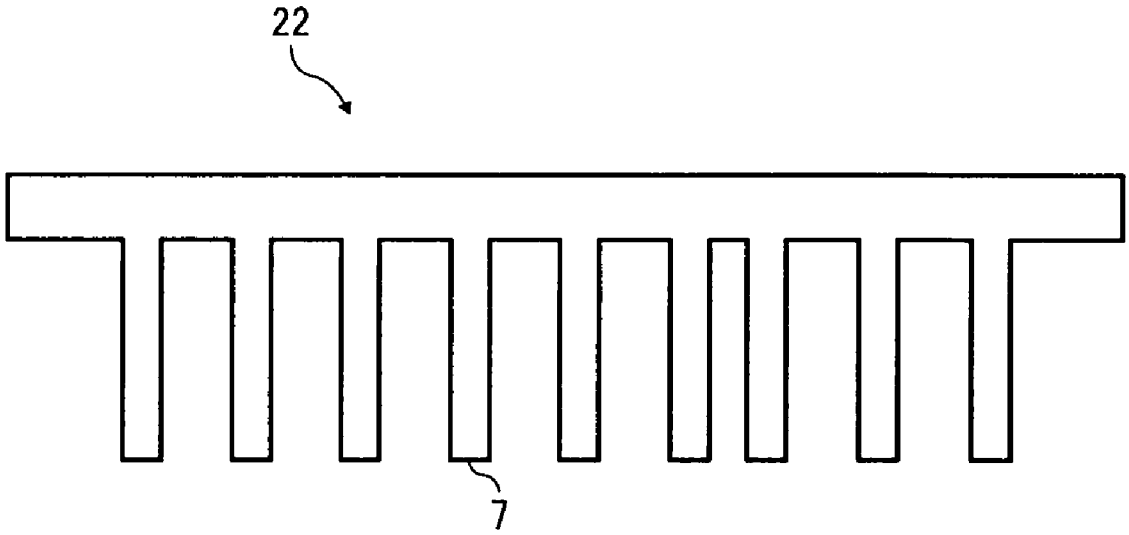
FIG. 16 is a front view showing flight electrodes having a comb teeth shape.

Furthermore, by using etching or the like to integrally form a plurality of flight electrodes 7 in a comb teeth manner as shown in FIG. 16 when forming the one-dimensional discharge unit 20 or the two-dimensional discharge unit 21, and forming the insulating film 8 on the outer circumferential surface of each of the flight electrodes 7, flight electrode pairs 22 can be manufactured easily.

Figure 17:
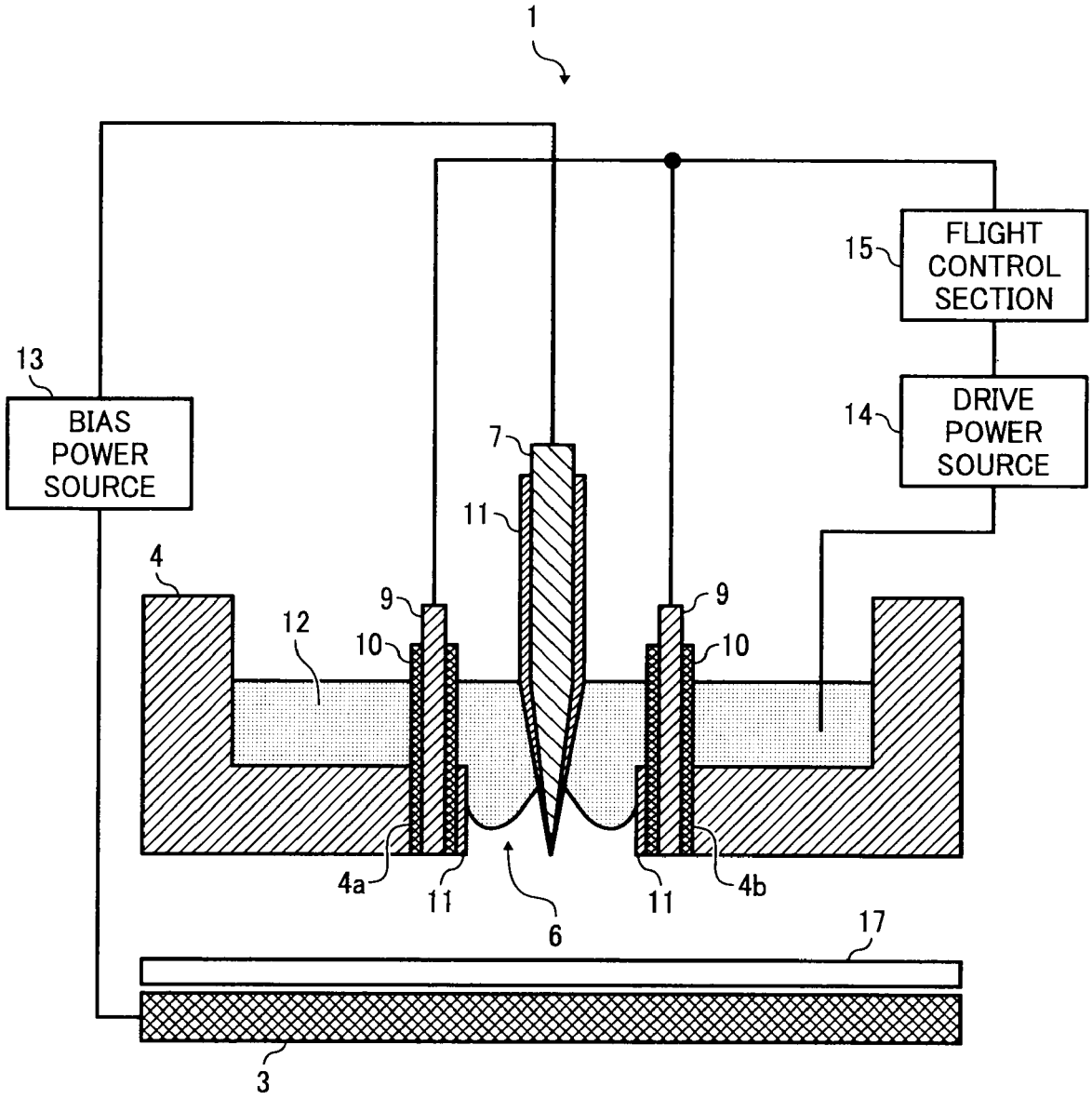
FIG. 17 is a cross-sectional view showing a configuration of a fourth liquid droplet flight device.

Further still, by making the leading end of the flight electrode 7 acute as shown in FIG. 17, the electric field produced by the flight electrodes 7 can be further stabilized and the ink 12 moved by the electrowetting phenomenon can be moved easily to the leading end portion of the flight electrode 7, thereby enabling further increased printing speeds to be achieved.

Figure 18:
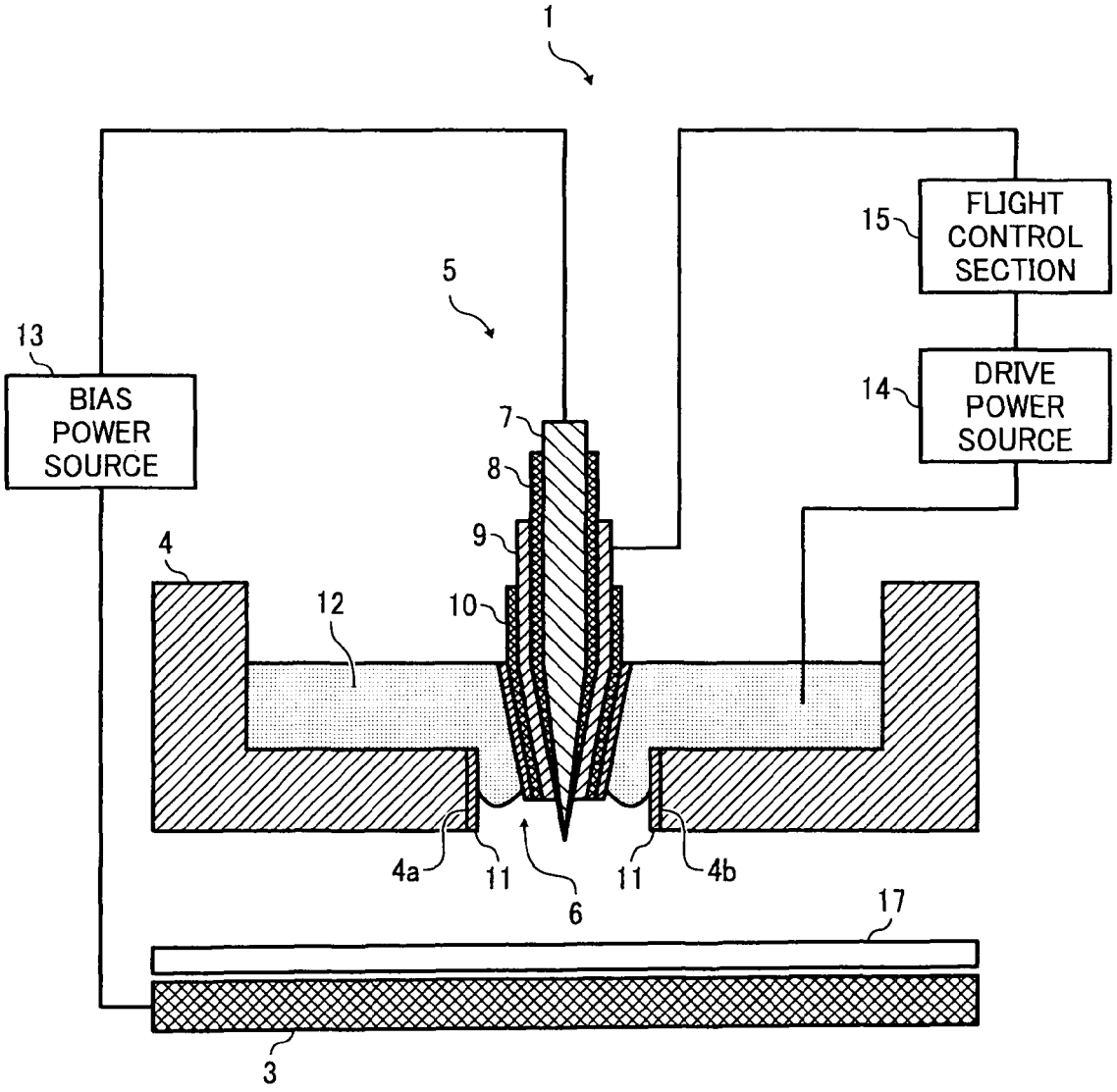
FIG. 18 is a cross-sectional view showing a configuration of a fifth liquid droplet flight device.

Furthermore, the EW drive electrode 9 may be formed integrally with the flight electrode 7 as shown in FIG. 18 and the water-repellent film 11 may also be provided on both wall surfaces 4*a* and 4*b* forming the slit 6 of the liquid retaining section 4.

Figure 19A:
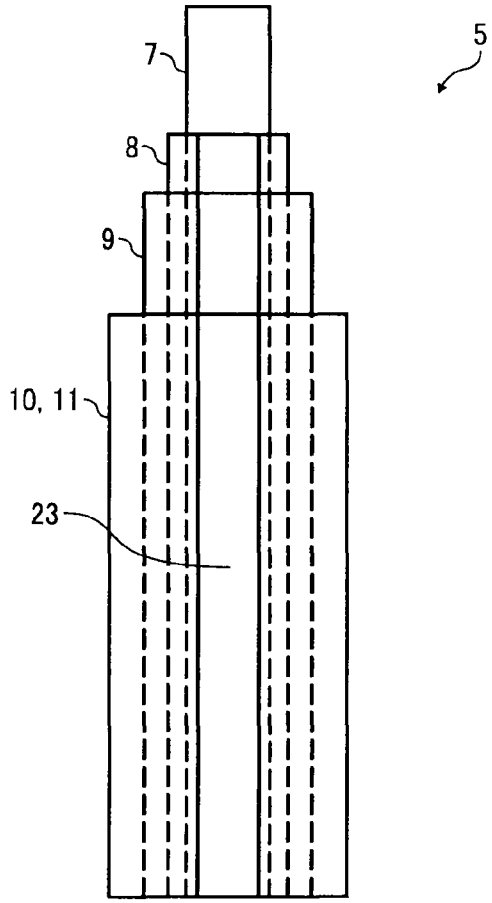
FIG. 19A and FIG. 19B are lateral views showing a configuration of electrode portions having flight electrodes in which ink guiding paths are arranged.
Figure 19B:
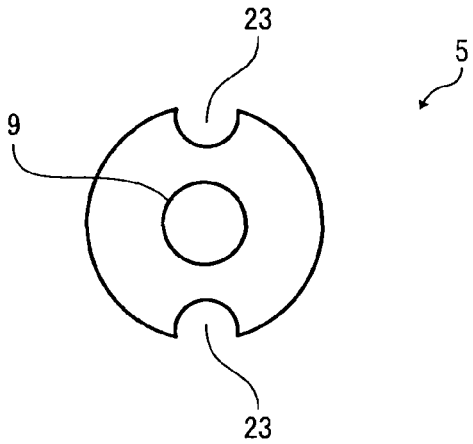

In the foregoing descriptions, description was given regarding cases where the ink 12 in the slit 6 of the liquid retaining section 4 was moved using an electrowetting phenomenon at a leading end of the flight electrode 7, but as shown in the lateral view of FIG. 19A and the bottom view of FIG. 19B, instead of the slit 6, a single or multiple ink guiding paths 23 that are U-shaped, V-shaped, or spiral may be provided in the flight means 5 having the flight electrode 7, such that the ink 12 retained in the liquid retaining section 4 is guided to the ink guiding path(s) 23, and the ink 12 is moved to the leading end of the flight electrode 7 using an electrowetting phenomenon.

Figure 20A:
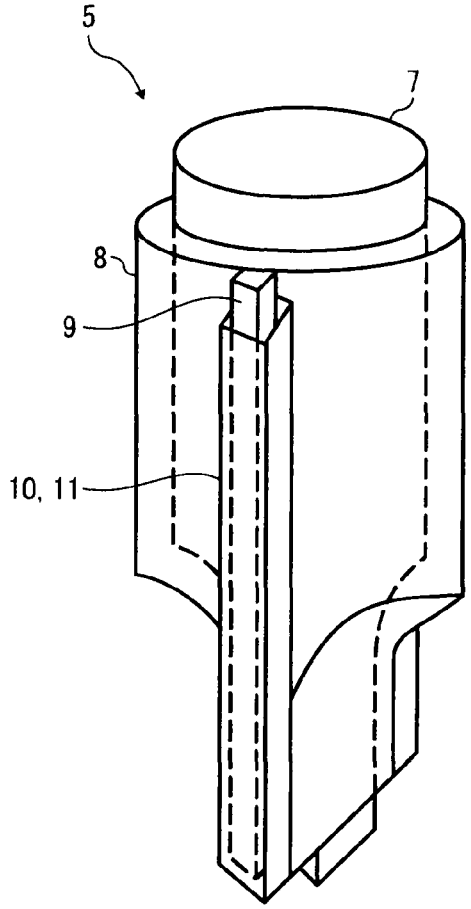
FIGS. 20A to 20E are cross-sectional views showing forms in which the flight electrodes are concealed.
Figure 20B:
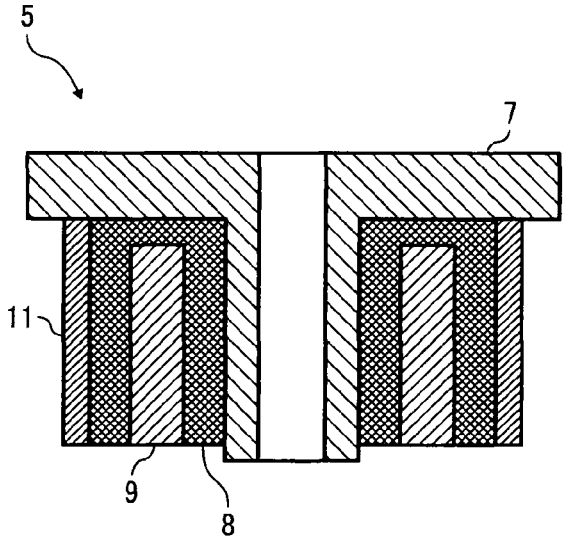
Figure 20C:
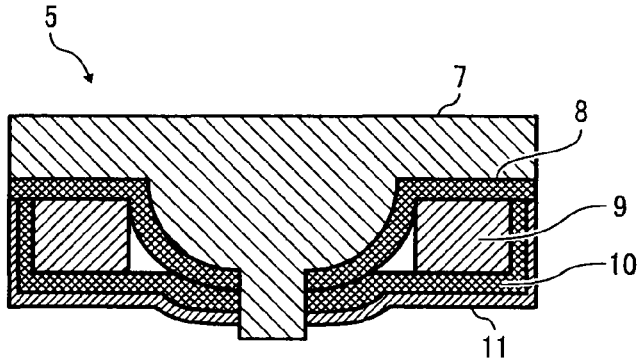
Figure 20D:
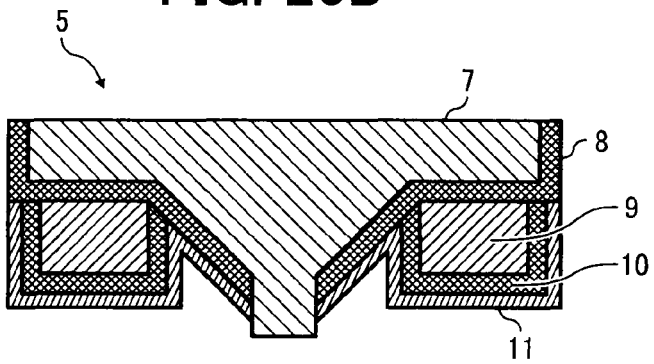
Figure 20E:
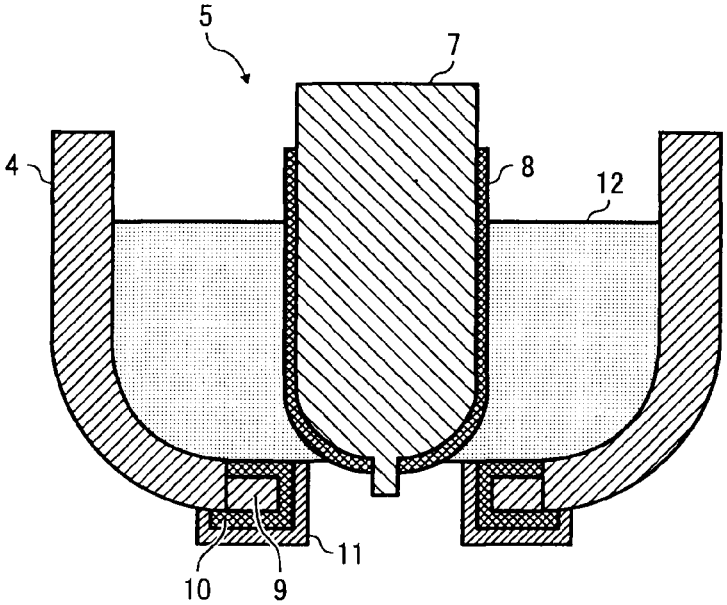

Furthermore, in the foregoing descriptions, description was given regarding cases where a rod shaped flight electrode 7 was provided in the flight means 5 of the liquid droplet flight device 1, which caused the ink droplets 12*a* to fly using the one-dimensional discharge unit 20 or the two-dimensional discharge unit 21 in which ink droplets 12*a* of the image forming apparatus were caused to fly, but as shown in FIG. 20A, the leading end portion that is arranged inside the slit 6 of the liquid retaining section 4 of the flight electrode 7 may be formed into a flat shape, and as shown in FIG. 20B, the leading end portion that is arranged inside the slit 6 of the liquid retaining section 4 of the flight electrode 7 may be formed into a cylindrical shape, and as shown in FIG. 20C, the leading end portion that is arranged inside the slit 6 of the liquid retaining section 4 of the flight electrode 7 may be formed into a globular shape, and as shown in FIG. 20D, the leading end portion that is arranged inside the slit 6 of the liquid retaining section 4 of the flight electrode 7 may be formed into a truncated cone shape with an acute portion provided at the leading end, and as shown in FIG. 20E, the flight electrode 7 arranged inside the slit 6 of the liquid retaining section 4 may take a ball pen shape, and various other shapes can be employed.

Hereinafter, examples are given of effects of the present invention.

(1) By applying a low voltage between the EW drive electrode and the liquid inside the liquid retaining section by the flight control means while a high voltage is applied between the flight electrode, which is arranged in a liquid holding section that holds liquid of the liquid retaining section, and the opposing electrode to cause the liquid of the liquid holding section to move within an electric field generated by the flight electrode using an electrowetting phenomenon, thereby causing a liquid droplet to fly onto a medium arranged between the liquid droplet discharge means and the opposing electrode, it is possible to cause liquid droplets to fly stably using a low voltage and the structure of the flight control means can be simplified such that a low cost can be achieved for the liquid droplet flight device.

(2) By applying a drive voltage to the flight electrode to move the liquid inside the liquid holding section, which is constituted by a slit or pass-through holes, until a leading end portion of the flight electrode using the electrowetting phenomenon, high viscosity liquids can be caused to fly stably.

(3) By integrally forming the EW drive electrode with the flight electrode along an outer circumferential surface of the flight electrode, and providing an insulating water-repellant film at an outer circumferential surface of the EW drive electrode, the structure of the flight electrode and the EW drive electrode can be simplified and can be positioned stably within the liquid holding section.

(4) By integrally forming EW drive electrode with the flight electrode along an outer circumferential surface of the flight electrode, providing an insulating water-repellant film at an outer circumferential surface of the EW drive electrode, and forming a liquid holding section of the liquid retaining section using a groove formed along the insulating water-repellant film, the flight electrode, the EW drive electrode, and the liquid holding section can be formed using a simple structure.

(5) Furthermore, by making the leading end portion of the flight electrode acute, the liquid inside the liquid holding section can be moved to the leading end portion of the flight electrode using the electrowetting phenomenon and the strength of the electric field that is generated can be increased such that the efficiency of liquid droplet flight can be improved and higher speeds can be achieved.

(6) Further still, by arranging the EW drive electrode on a wall surface parallel to the flight electrode of the liquid holding section, arranging the flight electrode on a wall surface of the liquid holding section, and arranging the EW drive electrode on a wall surface opposing the wall surface of the liquid holding section where the flight electrode is arranged, the liquid inside the liquid holding section can be moved with greater efficiency to the leading end portion of the flight electrode using the electrowetting phenomenon.

(7) Furthermore, by causing ink droplets to fly onto a recording medium using a liquid droplet flight device according to the present invention to form an image, it is possible to form high image quality images stably and to achieve faster printing speeds.

In a preferred aspect, a voltage to be applied to the EW drive electrodes is set so as to be smaller than 1/10 of a voltage to be applied between the flight electrodes and an opposing electrode by the electric field generating device.

Various modifications will become possible for those skilled in the art after receiving the teachings of the present disclosure without departing from the scope thereof.

What is claimed is:

1. A liquid droplet flight device, comprising:

liquid droplet discharge means; and an opposing electrode arranged facing the liquid droplet discharge means with a space therebetween, wherein the liquid droplet discharge means includes a liquid retaining section having a slit-shaped liquid holding section that is formed at a bottom thereof so as to hold a liquid configured to fly, and flight means that causes the liquid held in the liquid holding section to fly, the flight means includes a needle-shaped flight electrode extending beyond an outermost surface of the liquid holding section nearest to a discharge point, a first insulating film arranged on an outer circumferential surface of the flight electrode, an electro-wetting (EW) drive electrode arranged on an outer circumferential surface of the first insulating film, a second insulating film that covers an outer circumferential surface of the EW drive electrode, a water-repellent film arranged on an outer circumferential surface of the second insulating film, electric field generating means for generating an electric field between the flight electrode and the opposing electrode, and flight control means for moving the liquid of the liquid holding section to the electric field generated by the flight electrode of the electric field generating means using an electrowetting phenomenon by applying a voltage between the EW drive electrode and the liquid inside the liquid retaining section, a leading edge portion of the flight means is arranged so as to protrude from the liquid holding section, and a low voltage is applied between the EW drive electrode and the liquid inside the liquid retaining section by the flight control means, while a high voltage is applied between the flight electrode and the opposing electrode by the electric field generating means in order to cause a liquid droplet to fly onto a medium arranged between the liquid droplet discharge means and the opposing electrode.

2. The liquid droplet flight device as claimed in claim 1, wherein the liquid holding section of the liquid retaining section includes a pass-through hole.

3. The liquid droplet flight device as claimed in 1, wherein the EW drive electrode is integral with the flight electrode along an outer circumferential surface of the flight electrode, and an insulating water-repellant film is provided at an outer circumferential surface of the EW drive electrode.

4. The liquid droplet flight device as claimed in 1, wherein the EW drive electrode is integral with the flight electrode along an outer circumferential surface of the flight electrode, an insulating water-repellant film is provided at an outer circumferential surface of the EW drive electrode, and a liquid holding section of the liquid retaining section is formed using a groove formed along the insulating water-repellant film.

5. The liquid droplet flight device as claimed in 1, wherein a leading end portion of the flight electrode is acute.

6. The liquid droplet flight device as claimed in 1, wherein the EW drive electrode is arranged on a surface of a wall parallel to the flight electrode of the liquid holding section.

7. The liquid droplet flight device as claimed in 1, wherein the flight electrode is arranged on a surface of an inner wall of the liquid holding section, and the EW drive electrode is arranged on a surface opposing the surface of the inner wall of the liquid holding section where the flight electrode is arranged.

8. An image forming apparatus, comprising:

an ink droplet flight device that discharges ink droplets onto a recording medium transported on a transport path, in order to record text or images, wherein the ink droplet flight device comprises ink droplet discharge means and an opposing electrode arranged facing the ink droplet discharge means with a space therebetween, the ink droplet discharge means includes an ink retaining section having an ink holding section is formed at a bottom thereof with a slit or a plurality of one-dimensionally arranged pass-through holes that hold ink configured to fly, and flight means for causing the ink held in the ink holding section to fly, the flight means includes: a plurality of flight electrodes formed in a needle shape, arranged in a comb teeth manner inside the ink holding section and extending beyond an outermost surface of the ink holding section nearest to a discharge point; a first insulating film arranged on an outer circumferential surface of each of the flight electrodes; an electro-wetting (EW) drive electrode arranged on an outer circumferential surface of each first insulating film, a second insulating film that covers an outer circumferential surface of each EW drive electrode, a water-repellent film arranged on an outer circumferential surface of each second insulating film; electric field generating means that generates an electric field between the plurality of flight electrodes and the opposing electrode; and flight control means that moves the ink of the ink holding section to the electric field generated by the flight electrodes of the electric field generating means using an electrowetting phenomenon by applying a voltage between the EW drive electrodes and the ink near each of the flight electrodes inside the ink retaining section, a leading edge portion of the flight means is arranged so as to protrude from the ink retaining section, and a pulse-form low voltage is applied between the EW drive electrodes and the ink near each of the flight electrodes inside the ink retaining section by the flight control means, while a high voltage is applied between the flight electrodes and the opposing electrode by the electric field generating means in order to cause ink droplets to fly onto a recording medium transported between the ink droplet discharge means and the opposing electrode.

9. The image forming apparatus as claimed in claim 8, wherein the flight means is arranged two-dimensionally inside the ink holding section.

10. The image forming apparatus as claimed in claim 9, wherein the EW drive electrodes are integral with the flight electrodes along an outer circumferential surface of the flight electrodes, and an insulating water-repellant film is provided at an outer circumferential surface of the EW drive electrodes.

11. The image forming apparatus as claimed in claim 9, wherein the EW drive electrodes are arranged on a wall surface parallel to the flight electrodes of the ink holding section.

12. The image forming apparatus as claimed in claim 9, wherein the flight electrodes are arranged on a surface of an inner wall of the ink holding section, and the EW drive electrodes are arranged on a surface opposing the surface of the inner wall of the ink holding section where the flight electrodes are arranged.

13. The image forming apparatus as claimed in claim 9, wherein the plurality of flight electrodes are arranged in an array having a pitch equal to an image resolution of the image forming apparatus.

14. The image forming apparatus as claimed in claim 9, wherein a viscosity of ink retained in the ink retaining section is at least 8 mPas.

15. The image forming apparatus as claimed in claim 9, wherein a voltage to be applied to the EW drive electrodes by the flight control means is set smaller than 1/10 of a voltage to be applied between the flight electrodes and the opposing electrode by the electric field generating means.

16. The image forming apparatus as claimed in claim 9, wherein at least two rows of the ink droplet discharge means are arranged parallel to a direction orthogonal to the slit or are one-dimensionally arranged with a plurality of pass-through holes.

17. The image forming apparatus as claimed in claim 9, wherein the at least two rows of the ink droplet discharge means are arranged in an array having different phases in a direction of the slit or are one-dimensionally arranged with a plurality of pass-through holes.

18. The image forming apparatus as claimed in claim 9, wherein the flight control means of the ink droplet flight device applies a voltage between the EW drive electrodes and the ink near each of the flight electrodes inside the ink retaining section in response to image data.

19. The liquid droplet flight device as claimed in claim 1, wherein the a leading edge portion of the flight means forms a planar surface which faces the opposing electrode and cross-sects the needle-shaped flight electrode, the first insulating film, the EW drive electrode, the second insulating film, and the water-repellent film.

* * * * *